US012345477B2

(12) United States Patent
Myklebust et al.

(10) Patent No.: US 12,345,477 B2
(45) Date of Patent: Jul. 1, 2025

(54) HEAT EXCHANGER

(71) Applicants: Hydroniq Coolers AS, Ellingsøy (NO); Pleat AS, Stavanger (NO)

(72) Inventors: Rune Myklebust, Ellingsøy (NO); Stein Oddvar Sægrov, Stavanger (NO); Otto Godeset, Stavanger (NO)

(73) Assignees: Hydroniq Coolers AS, Ellingsøy (NO); Pleat AS, Stavanger (NO)

( * ) Notice: Subject to any disclaimer, the term of this patent is extended or adjusted under 35 U.S.C. 154(b) by 213 days.

(21) Appl. No.: 17/754,411

(22) PCT Filed: Oct. 14, 2020

(86) PCT No.: PCT/EP2020/078901
§ 371 (c)(1),
(2) Date: Mar. 31, 2022

(87) PCT Pub. No.: WO2021/074223
PCT Pub. Date: Apr. 22, 2021

(65) Prior Publication Data

US 2022/0341676 A1 Oct. 27, 2022

(30) Foreign Application Priority Data

Oct. 14, 2019 (NO) ..... 20191221

(51) Int. Cl.
*F28D 9/00* (2006.01)

(52) U.S. Cl.
CPC ..... *F28D 9/0075* (2013.01)

(58) Field of Classification Search
CPC ..... F28D 9/0075
See application file for complete search history.

(56) References Cited

U.S. PATENT DOCUMENTS 2,616,671 A * 11/1952 Wakeman ..... F28F 3/083 165/167
3,231,017 A * 1/1966 Henderson ..... F28F 3/08 29/890.039

(Continued)

FOREIGN PATENT DOCUMENTS

CN 103250020 A 8/2013
DE 817760 C 10/1951

(Continued)

OTHER PUBLICATIONS

International Search Report issued in PCT/EP2020/078901, mailed on Dec. 17, 2020 (3 pages).

(Continued)

*Primary Examiner* — Devon Lane
(74) *Attorney, Agent, or Firm* — Osha Bergman Watanabe & Burton LLP

(57) ABSTRACT

A modular system for heat exchange between fluids includes two end plates. At least one end plate is configured with inlets and outlets for fluids. The modular system includes a number of heat exchanger elements and a number of guiding elements. Each heat exchanger element includes a folded sheet material including a plurality of slits extending in a longitudinal direction of the folded sheet material, which longitudinal extending slits form the fluids flow paths. The folded sheet material is cast in one piece in an outer casing. A central opening of the outer casing covers an outer circumference of the folded sheet material, exposing a front side and a back side of the folded sheet material where two through holes, forming the inlets and outlets for each fluid, are provided on opposite sides of the central opening of the outer casing. Each guiding element includes two inlets and two outlets for fluids, and a bead or edge, provided on one side, forming an enclosure around the inlet and outlet for a first fluid, and a bead or edge on an opposite side, forming (Continued)

Figure 1A:
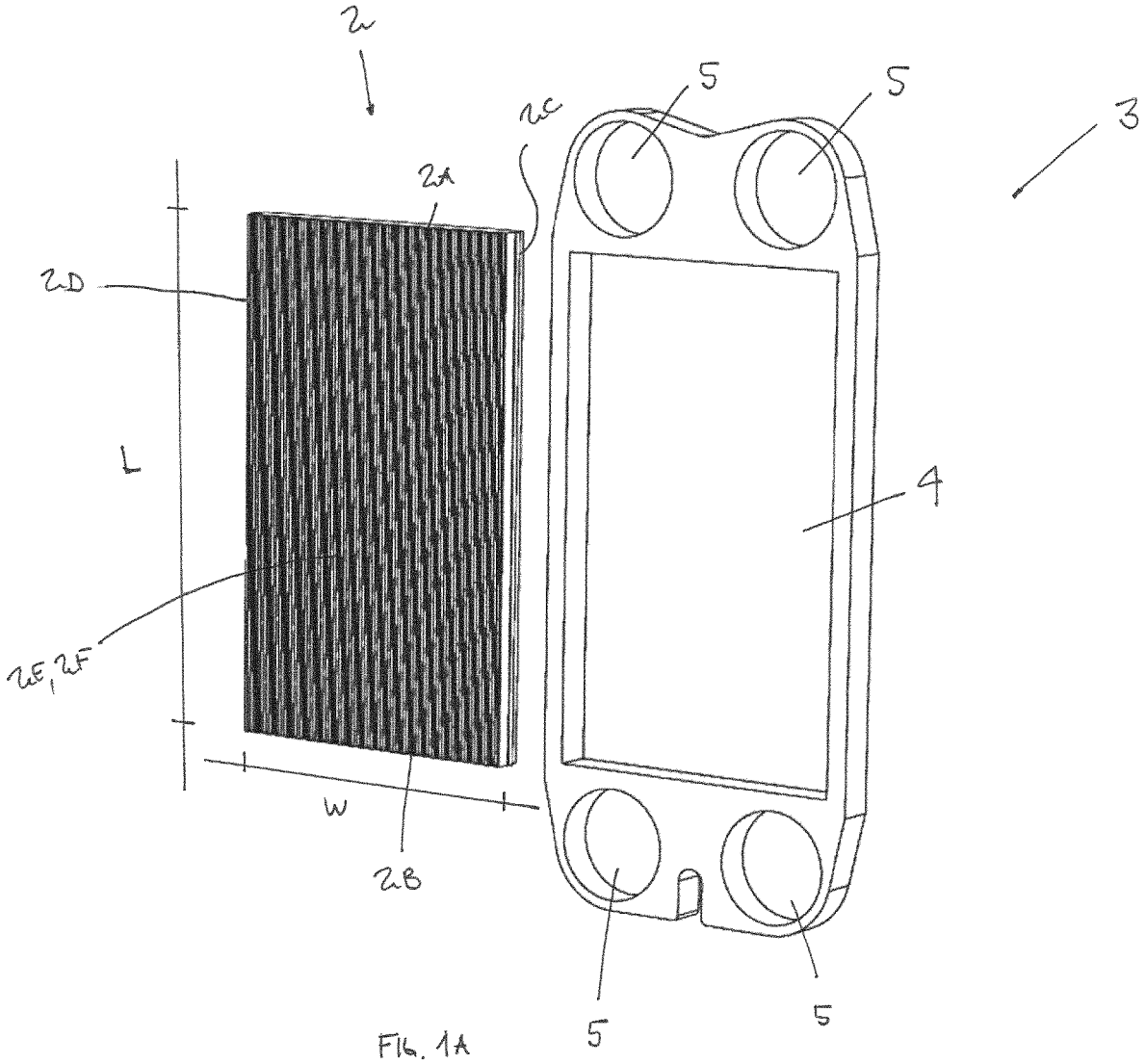

an enclosure around the inlet and outlet for a second fluid. Heat exchanger elements and guiding elements are arranged successively following each other. The heat exchanger elements are arranged that two adjacent heat exchanger elements on sides facing each other carry the same fluid.

12 Claims, 21 Drawing Sheets

(56) References Cited

U.S. PATENT DOCUMENTS

| | | | | |
|---|---|---|---|---|
| 5,968,321 | A * | 10/1999 | Sears | B01D 3/42 203/1 |
| 9,127,896 | B1 * | 9/2015 | Nehlen, III | B01D 29/012 |
| 2004/0094398 | A1 | 5/2004 | Karoliussen | |
| 2016/0282059 | A1 * | 9/2016 | Schiehlen | F28F 3/086 |
| 2018/0292143 | A1 * | 10/2018 | Aigner | B23K 1/008 |
| 2023/0070696 | A1 * | 3/2023 | Denoual | F28F 19/002 |

FOREIGN PATENT DOCUMENTS

| | | | |
|---|---|---|---|
| EP | 0039291 | A1 * | 11/1981 |
| EP | 941.759 | A1 | 9/1999 |
| FR | 2519579 | A1 * | 1/1982 |
| GB | 1043224 | A | 9/1966 |
| JP | 2014098527 | A * | 5/2014 |
| NO | 316475 | B1 | 1/2004 |
| WO | 95/30867 | A1 | 11/1995 |
| WO | 97/16691 | A1 | 5/1997 |
| WO | 2004072570 | A1 | 8/2004 |
| WO | 2012/033411 | A1 | 3/2012 |
| WO | 2017/053184 | A1 | 3/2017 |

OTHER PUBLICATIONS

Written Opinion of the International Searching Authority PCT/EP2020/078901, mailed on Dec. 17, 2020 (6 pages).
International Preliminary Report on Patentability issued in PCT/EP2020/078901, issued on Feb. 1, 2022 (13 pages).
Norwegian Search Report issued in counterpart Norwegian Patent Application No. 20191221, issued on Apr. 29, 2020 (2 pages).
Norwegian Search Report issued in counterpart Norwegian Patent Application No. 20191221, issued on May 20, 2021 (2 pages).
Office Action issued in Chinese Application No. 202080071745.0; Dated Dec. 12, 2023 (15 pages).

* cited by examiner

HEAT EXCHANGER

The present invention relates to a heat exchanger element for heat exchange between fluids, a guiding element for a heat exchanger element and a modular heat exchanger system comprising a larger or smaller number of guiding elements for heat exchanger elements and heat exchanger elements for heat exchange between fluids.

The present invention relates also to a method for manufacturing a heat exchanger element for heat exchange between fluids.

Heat exchangers are used for the transfer of heat between two fluid flows of different temperatures, where the heat exchangers, depending on their field of application, are designed for heating or cooling of a medium, heat recovery from a medium, or also condensation or evaporation of a medium.

For efficiency, heat exchangers are designed to maximize the heat transfer surface area between the two or more fluids, while minimizing resistance to fluid flow through the heat exchanger. The heat exchanger's performance may also be affected by the addition of fins and/or corrugations in one or both directions, which will increase the heat transfer surface area and may channel the fluid flow or induce turbulence.

Furthermore, the efficiency of the heat exchanger will be highly dependent on how clean the heat transfer surface area between the two or more fluids is. In many heat exchanger applications, the fluid that is used, for instance water or seawater, may cause fouling to occur on the heat transfer surface area. Such fouling occurs when impurities from the water or seawater deposit on the heat transfer surface area and may be caused by low wall shear stress, low fluid velocities, high fluid velocities, reaction product solid precipitation and precipitation of dissolved impurities due to elevated wall temperatures. The fouling will result in that the heat exchanger after a period of use, and when the heat transfer capacity approaches a given minimum level, must be dismantled in order to be cleaned.

In marine applications, heat exchangers are usually used for cooling of the propulsion system of a vessel, where seawater is used as the cooling fluid. Here, the cleaning of heat exchangers will be both critical and absolutely essential in order to maintain the vessel's required propulsive power.

Today the most common heat exchangers in the marine industry are plate heat exchangers. This type of heat exchangers is efficient and reliable but are difficult and complicated to clean. Such plate heat exchangers are comprised of many thin, slightly separated plates that have very large heat transfer surface area and small fluid flow passages for heat transfer. A plate heat exchanger may, for instance, comprise 50-150 plates and a corresponding number of gasket elements, where the plates and the gasket elements are assembled to form the plate package of the heat exchanger.

When a heat exchanger of this type is to be maintained or cleaned, it is usually necessary to disassemble the entire plate package. Each of the plates must then be cleaned on both sides, and the gasket elements must also be cleaned or replaced by new gasket elements.

Dismantling, cleaning and assembly of the said size of heat exchanger is considered to be a full day's job for two persons and represents a substantial cost because of time consumed and use of parts (replacement of gasket elements etc.). The complexity of the cleaning process will mean that there is greater dependence on both available competence and an adequate window of time in order to be able to carry out the cleaning. A lack of available competence and/or window of time will be usual and, as a result, such jobs are increasingly being put in the hands of external companies, which makes this process even more costly, or which also means that the vessel has an enforced period out of service with consequential loss of income.

The modular system for heat exchange between fluids and the heat exchanger element for heat exchange between fluids in the modular system according to the present invention cover the same range of applications as the plate heat exchangers described above but are provided to simplify the maintenance of the heat exchanger. Requirements as to special competence and/or a larger window of time are virtually eliminated.

According to the present invention, the modular system will comprise a plurality of open elements, for example, 2-7 open elements, and a corresponding number of individual gaskets. Dismantling, cleaning and assembly are reckoned to be a job of about one hour for one man. Moreover, time consumed, and replacement of gasket parts are so reduced as to become insignificant. Furthermore, the actual cleaning process will be so simple that all vessels will have available competence for carrying out this process and can therefore maintain full control of the cooling capacity of the heat exchanger and thus also critical propulsive power.

WO 2012/033411 A1 discloses a modular system for heat exchange between fluids, the system comprising a plurality of open elements which by means of two end plates are connected together. An open element is constituted of a folded and sealed sheet material that is arranged in an open frame.

WO 2017/053184 A1 discloses a one-piece heat exchanger manufactured using an additive manufacturing process. The heat exchanger includes a plurality of channels formed therein. At least some of the plurality of channels may be configured to provide structural support to the heat exchanger to reduce its weight. Different coolant media may be used in a first set and a second set of the plurality of channels to provide different types of cooling in an integrated one-piece heat exchanger structure.

WO 97/16691 A1 relates to a plate heat exchanger with a gasket positioned between the heat exchanger plates. The entry and outlet region from the entry and exit openings of the heat exchanger plates form a problem area, since, in this region, a gasket exists only in every second channel. Hereby, leaks may occur in this region. From the prior art solutions for avoiding or reducing the leaks in the outlet region of the entry and exit openings of the heat exchanger plates are known. In all these solutions the gaskets are still accommodated in a gasket groove. The object of the present invention is to avoid the leakiness in this region while obviating a gasket groove associated with disadvantages. According to the publication, this object is achieved, in that the corrugation extending from the entry and exit openings of the heat exchanger plates extends in a substantially radial direction to the heat exchanger surfaces and thereby uninterrupted traverses the region of the extent of the gasket and crosses the corresponding corrugations of the adjacent heat exchanger plates, such that the extent of the gasket is flanked on both sides by the crossing points of the corrugation hills of one plate with the corrugation troughs of the other plate, the gasket arranged between the heat exchanger plates varying in cross section to be adapted to the profile of the heat exchanger plates in this region, such that substantially the same specific gasket pressure is obtained over the whole extent of the gasket in a compressed condition.

EP 941.759 A relates to a method for producing a high temperature resistant exchanger. The exchanger is made from a number of tubes sealingly connected to a pipe plate which is further connected to an enclosure. The pipe plate is realized by positioning enclosure and tubes in a mould and pouring a ceramic slurry which is subsequently sintered.

WO 95/30867 A1 and NO 316475 B1 describe heat exchanger elements and the manufacture thereof, where it is known that the heat exchanger elements consist of a plate that is folded to form a plurality of slits, where the plate delimits the fluid to be heat exchanged, each fluid flowing in slits on either side of the plate.

US 2004/0094398 A1 discloses a heat exchanger, where the flowing canals for the fluids consist of slits on either side of a thin, folded sheet material, and where the ratio between the slit width of the canals and depths in the slits are less than 0.15 times the thickness of the sheet material.

The aforementioned documents do not teach a modular system for heat exchange between fluids where dismantling and assembly, cleaning and/or maintenance of the heat exchanger packages and or the heat exchanger system has been described and simplified.

An object of the present invention will therefore be to seek to solve one or more of the problems or drawbacks mentioned above.

Another object of the present invention will be to provide a heat exchanger element and a heat exchanger system for heat exchange between two or more fluids that are maintenance-friendly.

These objects are achieved with a method for manufacturing of a heat exchanger element for heat exchange between fluids, a heat exchanger element, a guiding element for a heat exchanger element and a modular system for heat exchange between fluids comprising a number of guiding elements and heat exchanger elements in accordance with the invention with the features of independent claim 1. Advantageous embodiments of the present invention are indicated in dependent claims.

The present invention relates to a method for manufacturing a heat exchanger element for heat exchange between fluids, where the heat exchanger element comprises a sheet material and an outer casing, wherein the method comprises the following steps:

- folding the sheet material into a plurality of slits extending in a longitudinal direction of the sheet material, thereby providing a folded sheet material having four end surfaces and two opposite heat transfer surfaces,
- placing the folded sheet material into a mould, and
- adding a material into the mould to cast the folded sheet material and an outer casing for the heat exchanger element in one piece, the moulding providing a heat exchanger element where the outer casing of the heat exchanger element covers only the end surfaces of the folded sheet material and leaving the two opposite heat transfer surfaces exposed through a central opening, the moulding further providing two through holes on opposite sides of the central opening of the outer casing, the two through holes forming the inlets and outlets for each fluid.

In an alternative embodiment the method for manufacturing a heat exchanger element may comprise the further step of adding a plurality of handles into the mould, whereby the heat exchanger element will be provided with handles.

The outer casing of the heat exchanger element will thus integrate with and cover the folded sheet material around a circumference of the folded sheet material, while the two opposite heat transfer surfaces will be open and exposed to the surroundings.

The above method for manufacturing of the heat exchanger element will provide a fluid tight connection between the outer casing and the folded sheet material, whereby the heat exchanger element can thus be manufactured without the use of gaskets, seals or the like.

In one embodiment the heat exchanger element may be manufactured by one end surface of the folded sheet material is placed in the mould and a material, for instance polyurethane (PU), is poured into the mould. When the material has solidified, the process is repeated for an opposite end surface of the folded sheet material.

Thereafter the process is repeated for the two remaining end surfaces of the folded sheet material.

When the heat exchanger element is to be manufactured with one or more handles, the one or more handles is/are added in the mould.

However, a person skilled in the art would know that also other materials could be used when the heat exchanger element is manufactured, such as an epoxy or the like.

The present invention relates also to a heat exchanger element for heat exchange between fluids, where the heat exchanger element comprises an outer casing and a folded sheet material comprising a plurality of slits extending in a longitudinal direction of the folded sheet material, the folded sheet material having four end surfaces and two opposite heat transfer surfaces (upper and lower heat transfer surfaces or left and right heat transfer surfaces), which longitudinal extending slits form the fluids flow paths, the folded sheet material and the plurality of handles being cast in one piece in the outer casing, the outer casing being provided with a central throughgoing opening, and where two through holes forming the inlets and outlets for each fluid are provided on opposite sides of the central throughgoing opening of the outer casing and where the throughgoing central opening exposes the two opposite heat transfer surfaces of the folded sheet material of the heat exchanger element.

The present invention also relates to a guiding element for a heat exchanger element, where the guiding element comprises two inlets and two outlets for fluids and a bead or edge provided on at least one side, forming an enclosure around an inlet and outlet for a first fluid. Such a guiding element is arranged on each side of the heat exchanger element, where the purpose of the guiding element(s) is/are to direct and force the fluid to flow through the slits provided in the heat exchanger element in order to obtain a desired flow of the fluids. Furthermore, the guiding elements will contribute strength to withstand a fluid pressure inside a modular system for heat exchange between fluids (both the actual fluid pressure and the differential pressure, i.e. the pressure difference between the fluids).

According to one aspect, a height and/or width of a guiding element may be larger than a height and/or width of a heat exchanger element.

The present invention relates also to a modular system for heat exchange between fluids, where the modular system comprises two end plates, at least one of the two end plates being configured with inlets and outlets for fluids, and where the modular system comprises a number of guiding elements for heat exchanger elements and a number of heat exchanger elements, where the number of guiding elements and heat exchanger elements are arranged successively following one another. Furthermore, the heat exchanger elements are arranged such that two adjacent or consecutive heat exchanger elements (with a guiding element arranged between them) on sides facing each other carry the same fluid.

Through the arrangements of inlets and outlets for fluids in one or both of the end plates, a person skilled in the art would know that the modular system could be arranged in such a way that both fluids may have inlets and outlets in the same end plate, that one end plate may have only inlet and outlet for one fluid and the other end plate may have inlet and outlet for the other fluid, or that one end plate may have inlets and outlets for two fluids, while the other end plate may have inlet and outlet for another fluid.

According to one embodiment, the inlets and outlets for fluids provided in the end plate(s), the guiding elements and the heat exchanger elements are provided such that, when the modular system is assembled, the inlets and outlets for fluids in each element (heat exchange element and guiding element) will align with corresponding inlets and outlets in remaining elements, so that there is no need to seal against fluid in different planes or heights.

A heat exchanger element according to the present invention should be understood to mean an element which exposes substantially the entire heat transfer surface through a central opening of the folded sheet material when the folded sheet material is integrated with the outer casing, the central opening exposing both a front side and a back side (or an upper and lower side) of the folded sheet material. The heat transfer surface of the heat exchanger element's folded sheet material is then fully accessible for a simple cleaning process from both sides of the heat exchanger element.

The number of heat exchanger elements and guiding elements arranged between the two end plates of the modular system for heat exchange between fluids may vary. For example, in one embodiment according to the present invention four guiding elements and three heat exchanger elements may successively be arranged between the two end plates, but it will be understood that both greater and smaller numbers of guiding elements and heat exchanger elements may be used in the modular system for heat exchange between fluids according to the present invention.

For assembly of the end plates, and the number of guiding elements and heat exchanger elements arranged therebetween, at least one elongate element may be used to lock and fixate the components or elements of the modular system for heat exchange between fluids. Each end plate may then be configured with at least one through hole, slot, cut-out or the like, where the at least one through hole, slot, cutout or the like in each end plate is coincident to allow the at least elongate element to be passed through each end plate so as to assemble and fasten the end plates and the number of intermediate guiding elements and heat exchanger elements.

In one embodiment according to the present invention, the at least one elongated element may be welded to one of the end plates and connected to the other end plate by means of a threaded connection, nut, rapid coupling etc., but it should be understood that the at least one elongate element may also be connected to the end plates in other ways, for example, by a threaded connection, nuts, rapid couplers etc.

When assembling the modular system for heat exchange between fluids according to the present invention, a desired number of guiding elements and heat exchanger elements may be arranged one after another between the two end plates. The guiding elements and the heat exchanger elements will be successively arranged, and the end plates will then be brought towards each other, whereafter one or more elongated elements are used to assemble and fasten the end plates and the number of intermediate guiding elements and heat exchanger elements.

The elongated elements may, for example, be constituted of bolts, bars or the like.

The modular system for heat exchange between fluids may also comprise at least an inlet filter, which inlet filter is suitably connected to the inlet for one of the fluids. The at least one inlet filter will then reduce the danger of blockages in the modular system for heat exchange between fluids. If one of the fluids that are run through the system is, for example, seawater, the inlet filter will prevent contaminants (sand, loose shells etc.) from penetrating into the number of guiding elements and heat exchanger elements.

When the end plates, the number of guiding elements and heat exchanger elements are assembled to form the modular system for heat exchange between fluids according to the present invention, the number of heat exchanger elements, with a guiding element arranged between then, are arranged such that two adjacent or subsequent heat exchanger elements will carry the same fluid on sides facing each other.

Each heat exchanger element that is used in the modular system for heat exchange between fluids according to the present invention comprises a sheet material that is folded to form a plurality of slits, which slits constitute the fluid flow paths through the heat exchanger element. Depending on the material of the sheet material, the sheet material may be "soft" or flexible, whereby the folded sheet material may be stiffened.

Such a stiffening of the sheet material may be obtained, for example, in that the sheet material over at least a part of its length and width is configured with a plurality of stamped portions, which stamped portions are separated from each other by a non-stamped portion. The stamped portions will then form the walls of the slits in the folded sheet material, whilst the non-stamped portions form the fold in the sheet material, the sheet material then being folded about each of the non-stamped portions.

A sheet material being stamped according to the present invention should be understood as meaning that the surface of the sheet material is exposed to an external force which will change the shape (projection/depression) of the sheet material. The stamping may be in the form of continuous or discontinuous grooves or channels, dots or also a combination thereof.

It should however be understood that the stiffening of the folded sheet material may also be obtained in other ways, for example, by provision of spacers between the slits of the folded sheet material.

The aforementioned stiffening means will result in the folded sheet material obtaining a desired stiffness over the whole or parts of the surface of the folded sheet material.

Although the slits in the folded sheet material in one exemplary embodiment are configured as planar faces, it should be understood that the slits may also be configured as part circles, arcs or the like. An exemplary embodiment is a structure consisting of forming one or more open areas that permit an efficient high-pressure washing in the slits.

The sheet material in the heat exchanger element may in one exemplary embodiment be of titanium or other suitable materials, where the sheet material then may have a thickness of 0.4 mm-0.6 mm. The distance between each slit in the folded sheet material may furthermore, as an example, be 2.5 mm-3.5 mm. However, a person skilled in the art would know that the distance between two adjacent slits also may be more or less.

According to one aspect, the guiding elements, heat exchanger elements, end plates etc. are manufactured with flat surfaces, such that the "sealing" between adjacent elements will remain tight even at different temperature expansions.

Other advantages and characteristic features of the present invention will be seen clearly from the following detailed description, the appended figures and the following claims.

Figure 1B:
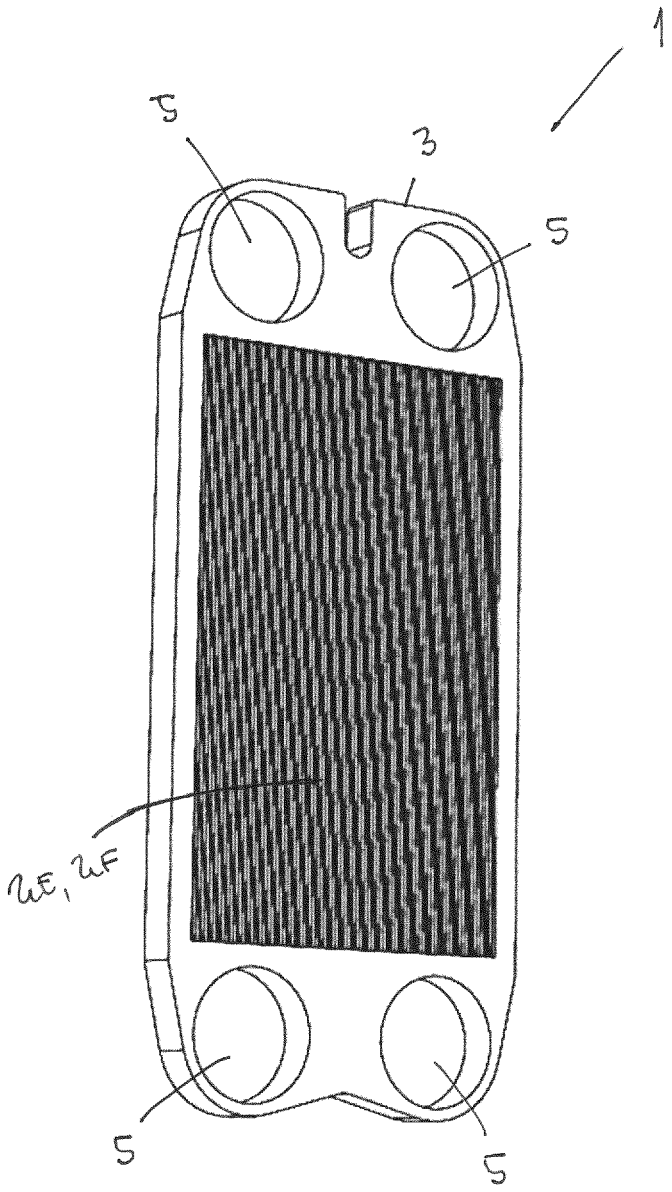
Figure 1C:
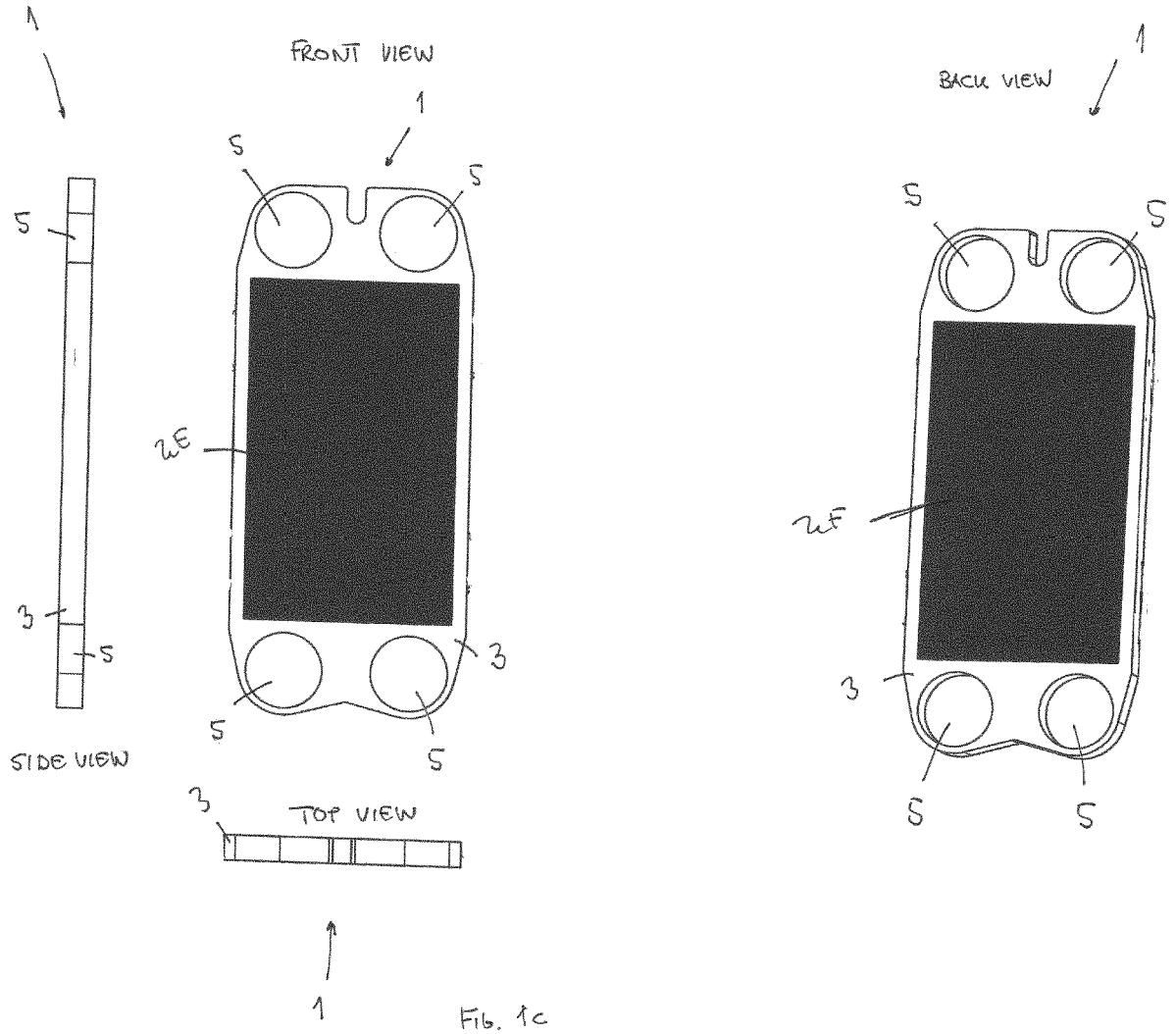
Figure 1D:
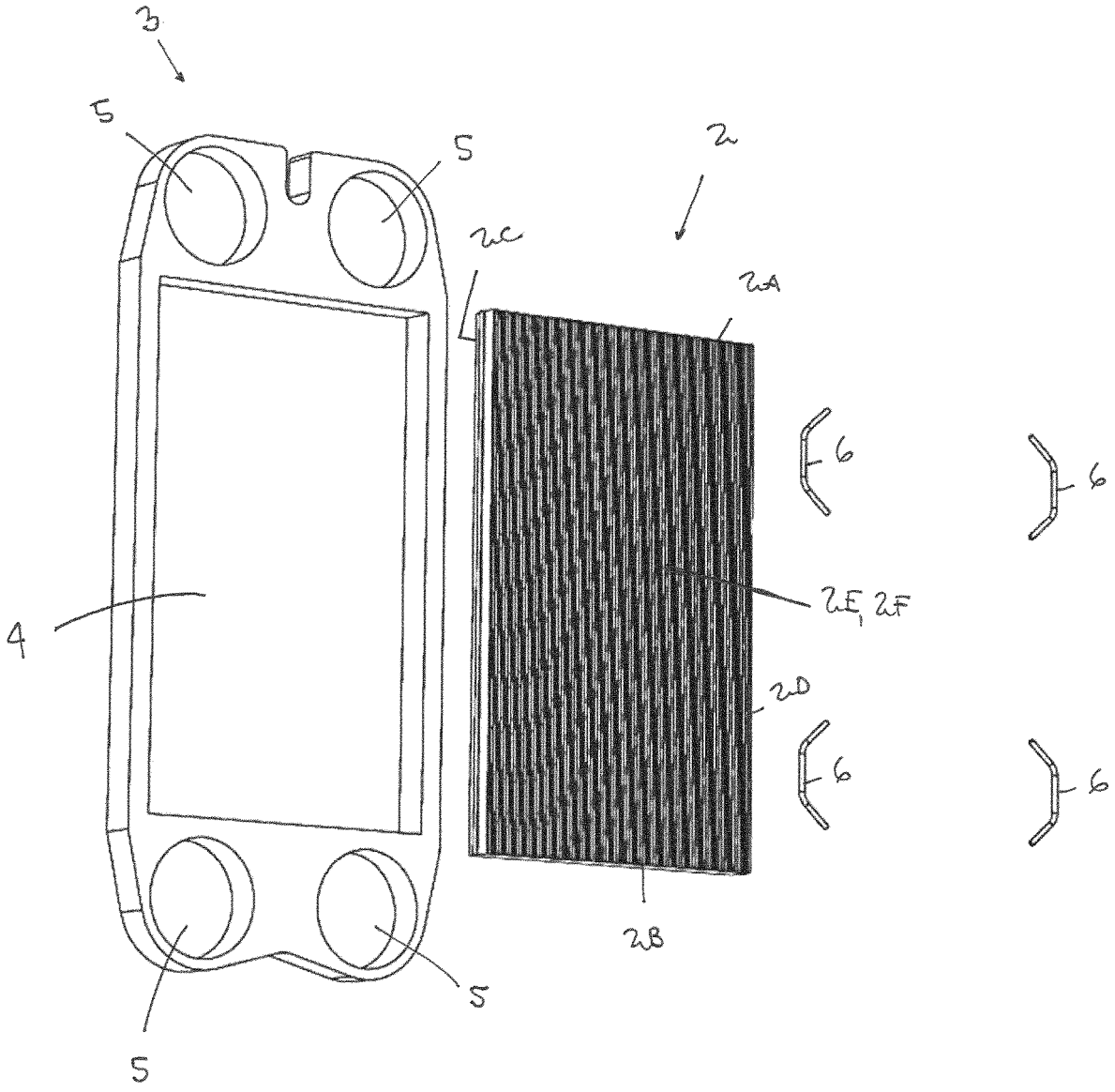
Figure 1E:
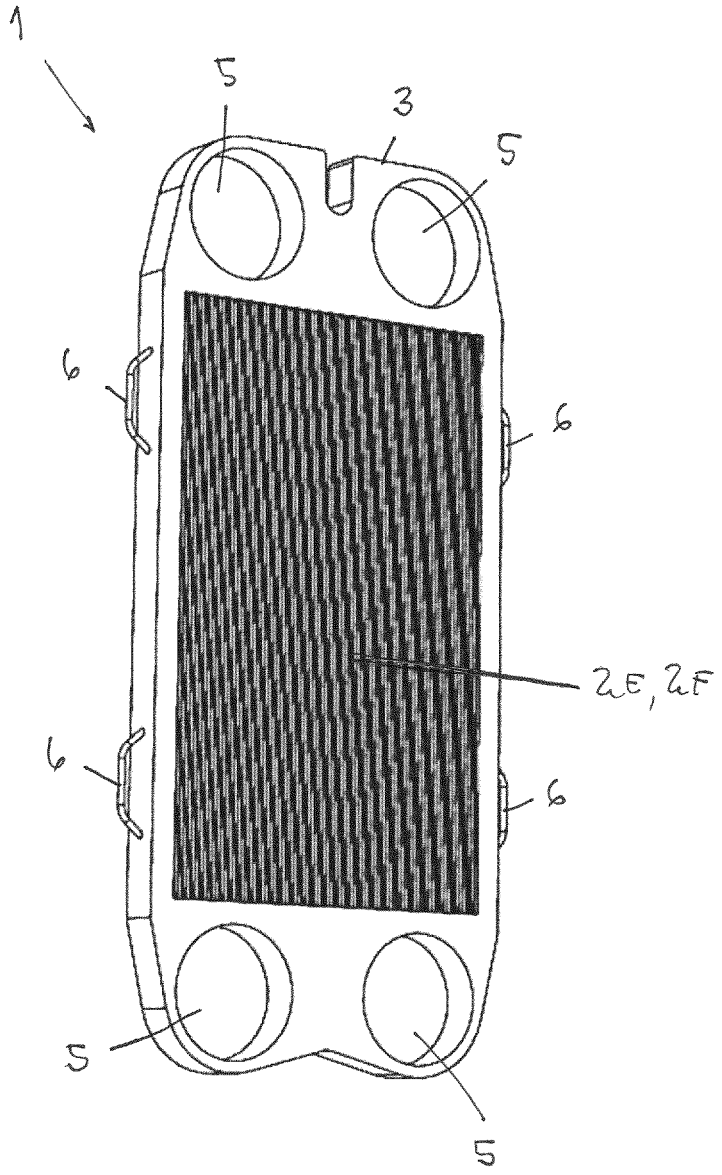
Figure 1F:
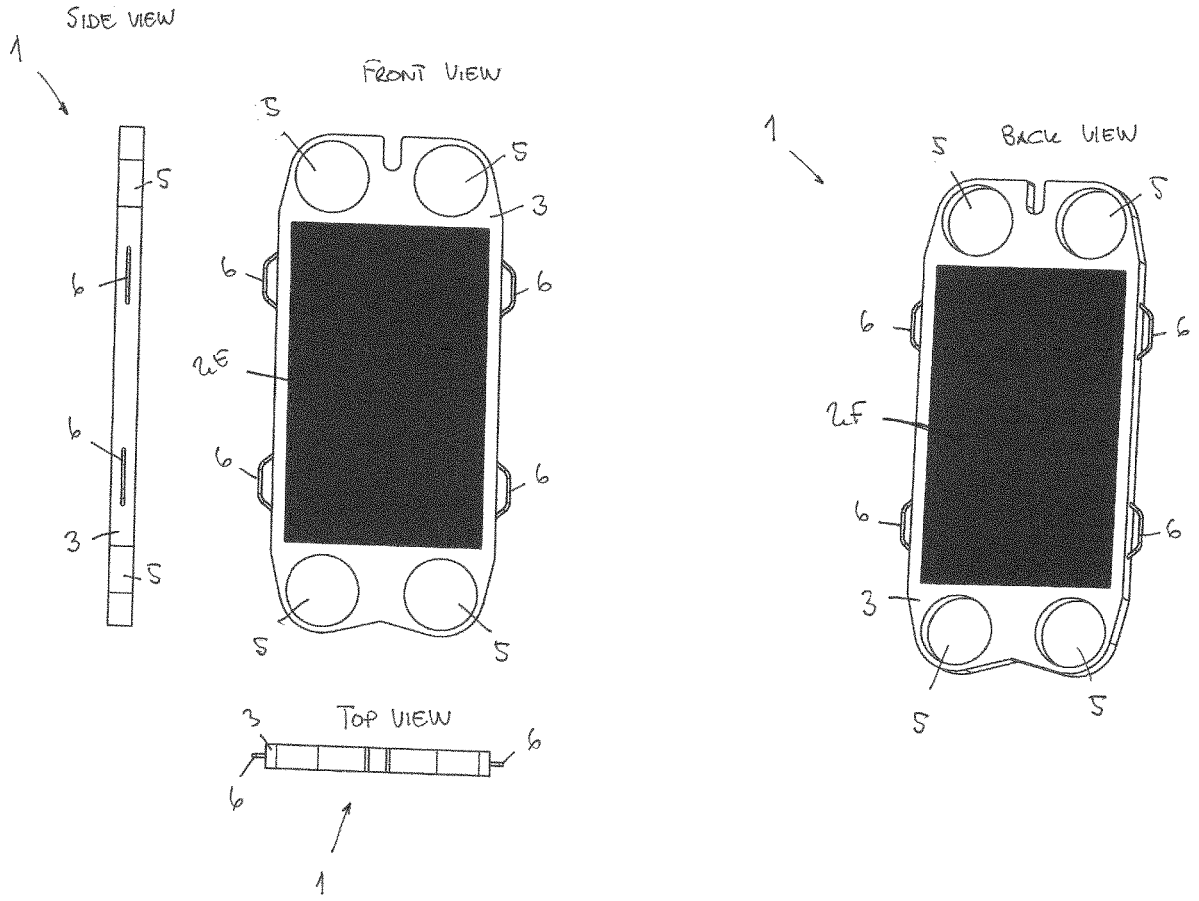
Figure 2D:
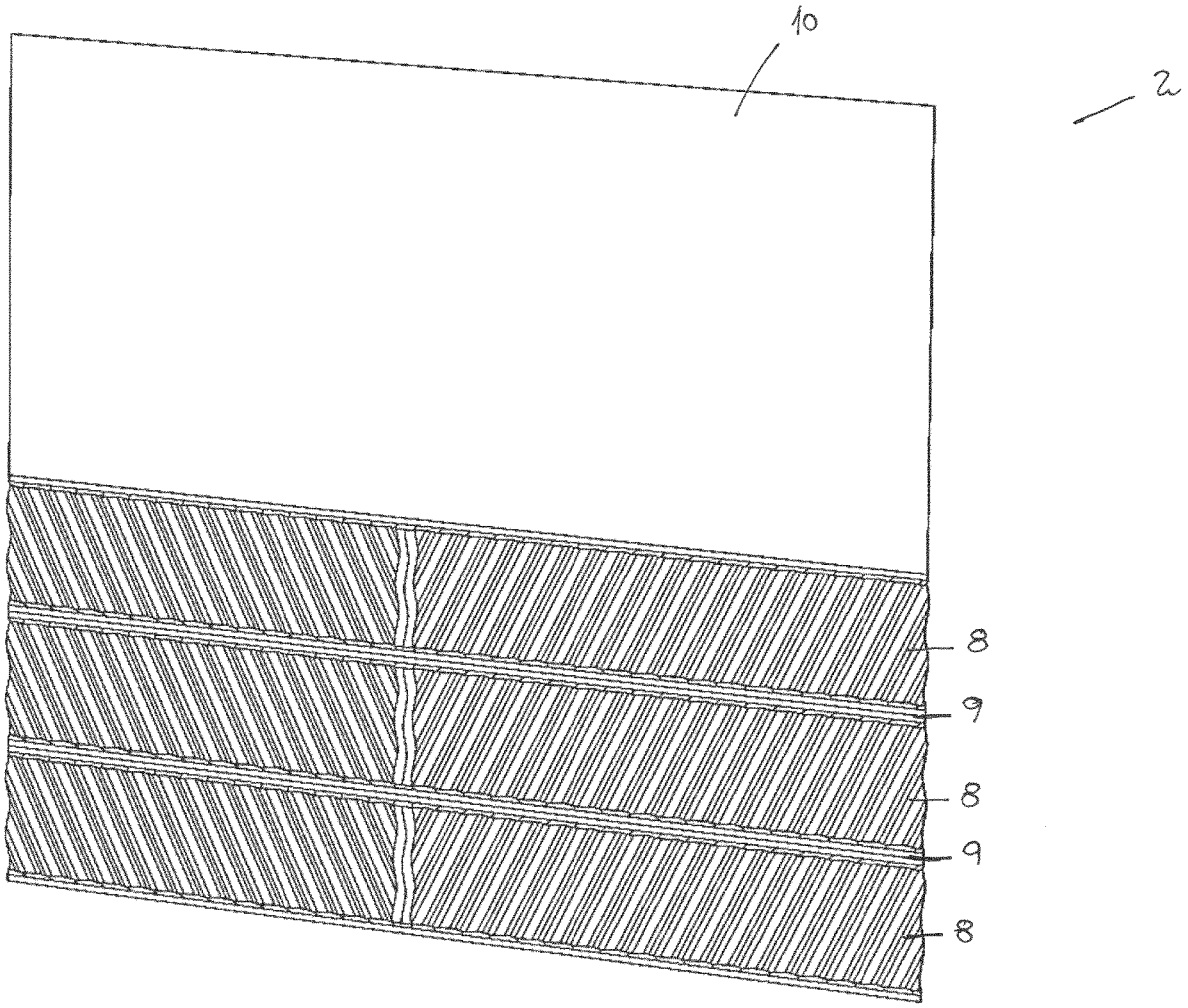
Figure 2B:
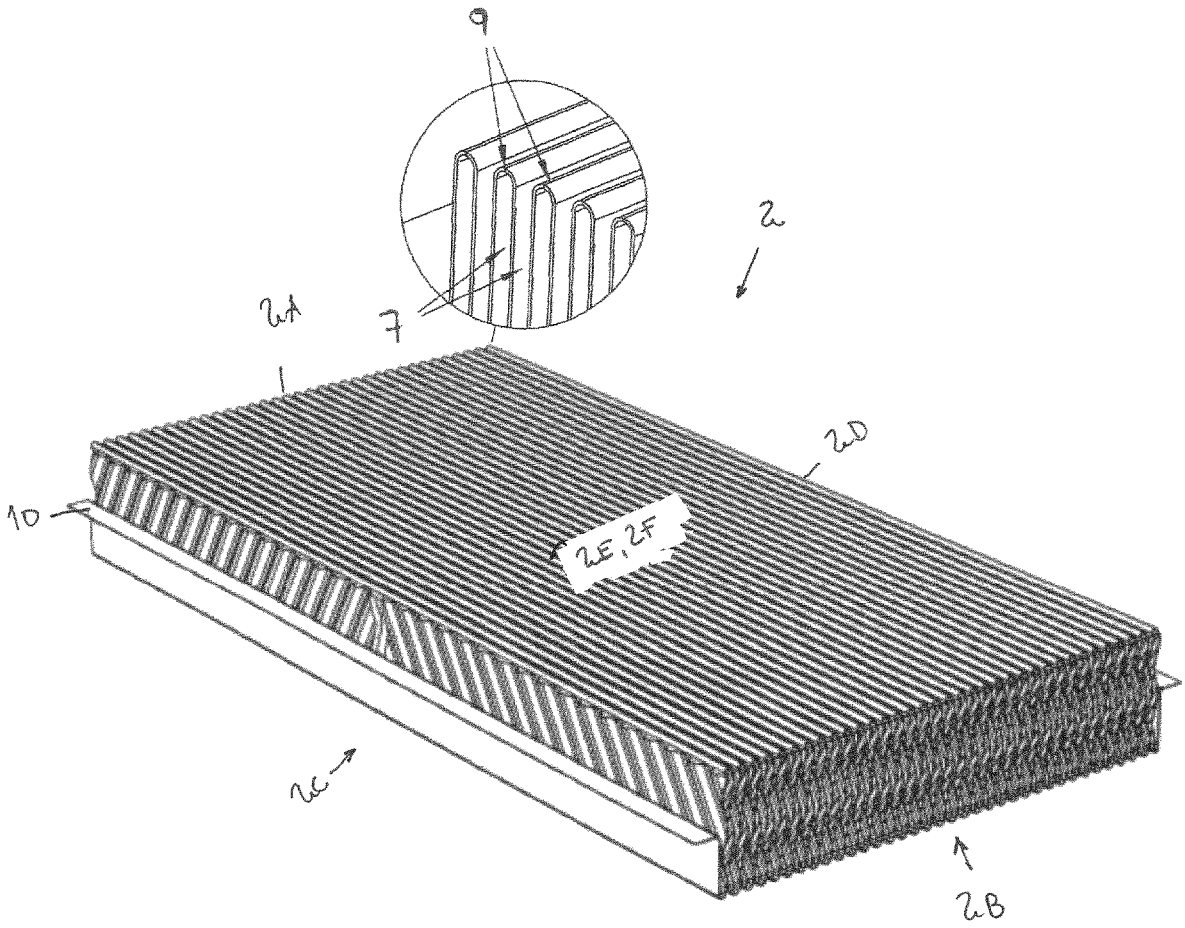
Figure 2C:
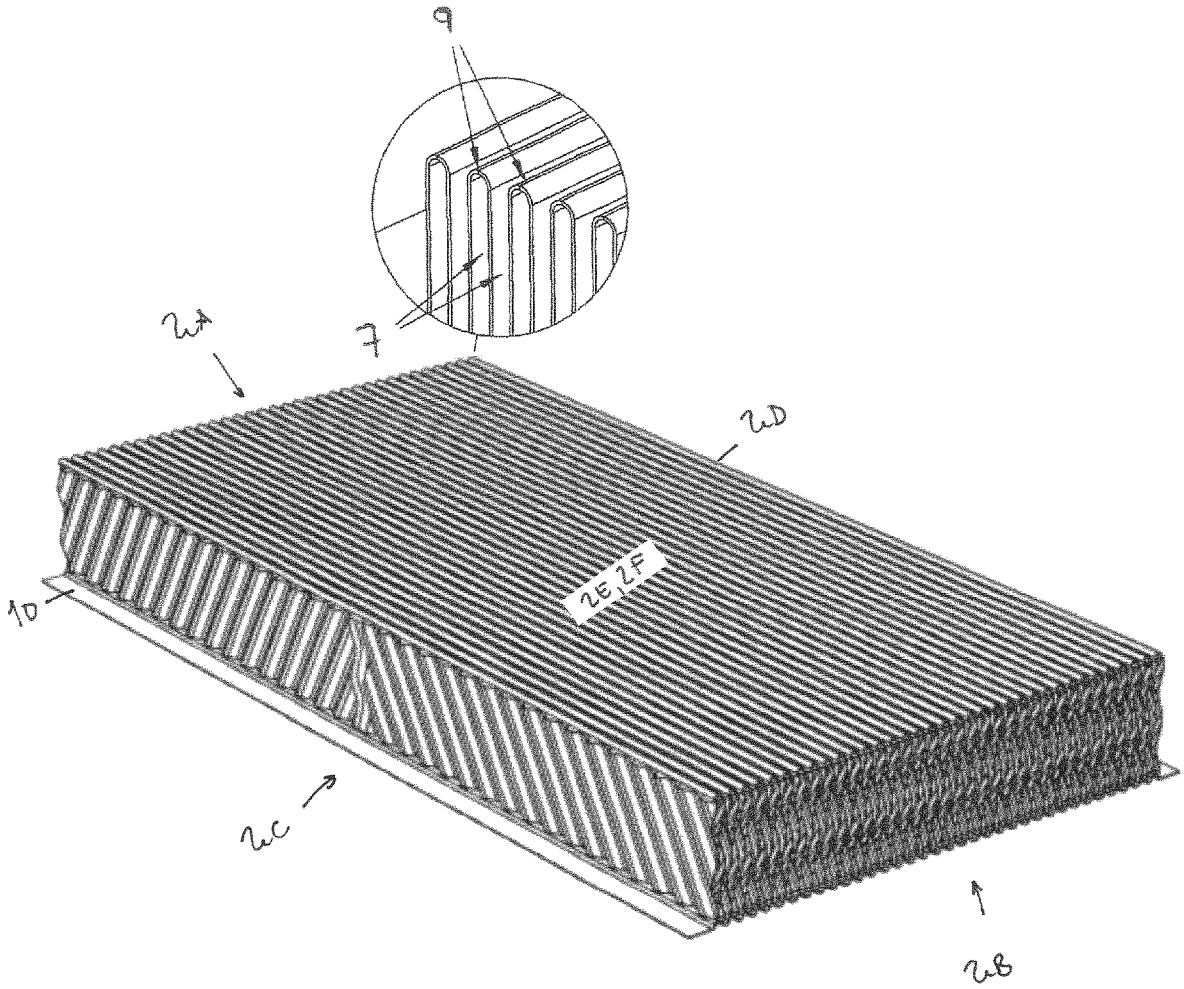
Figure 3A:
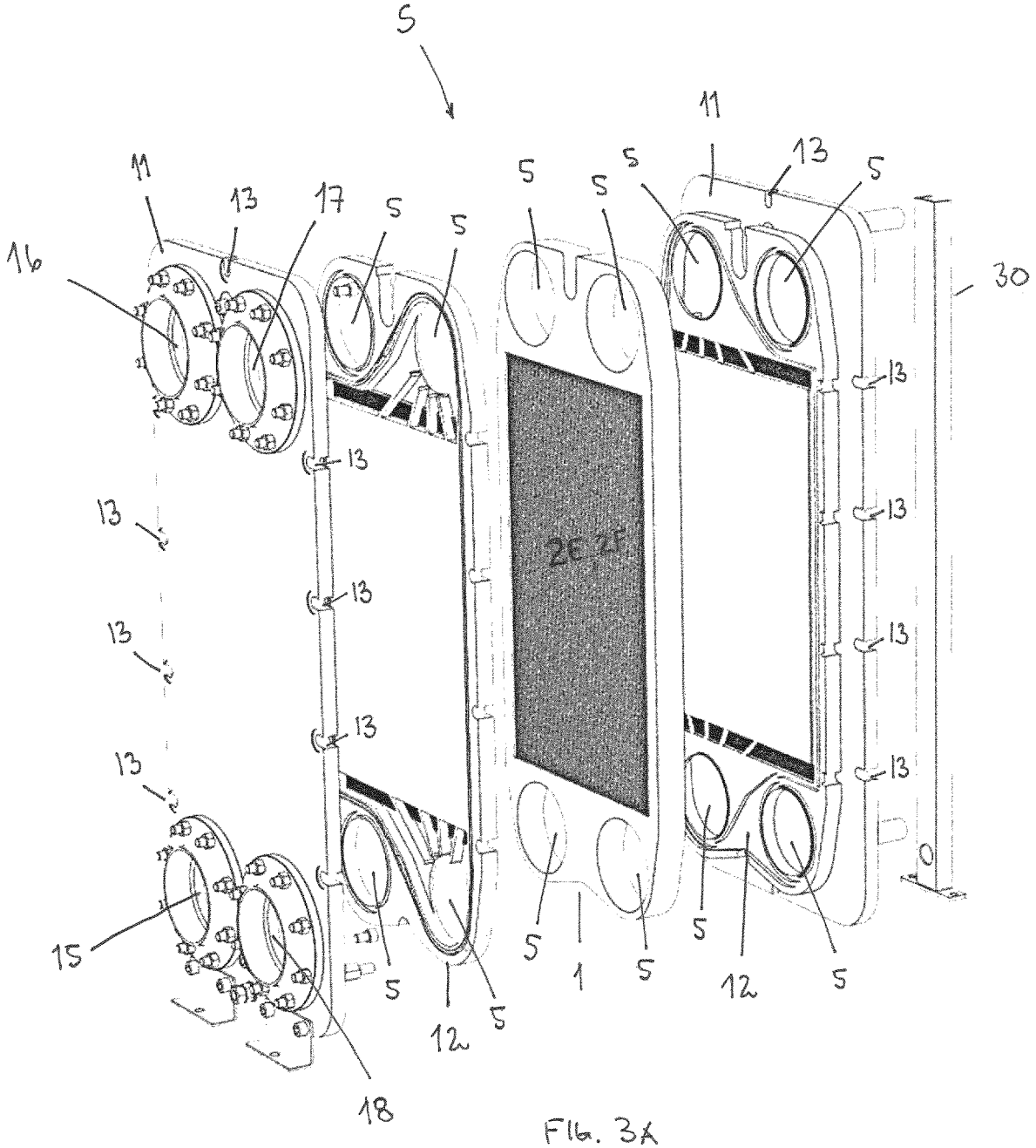
Figure 3B:
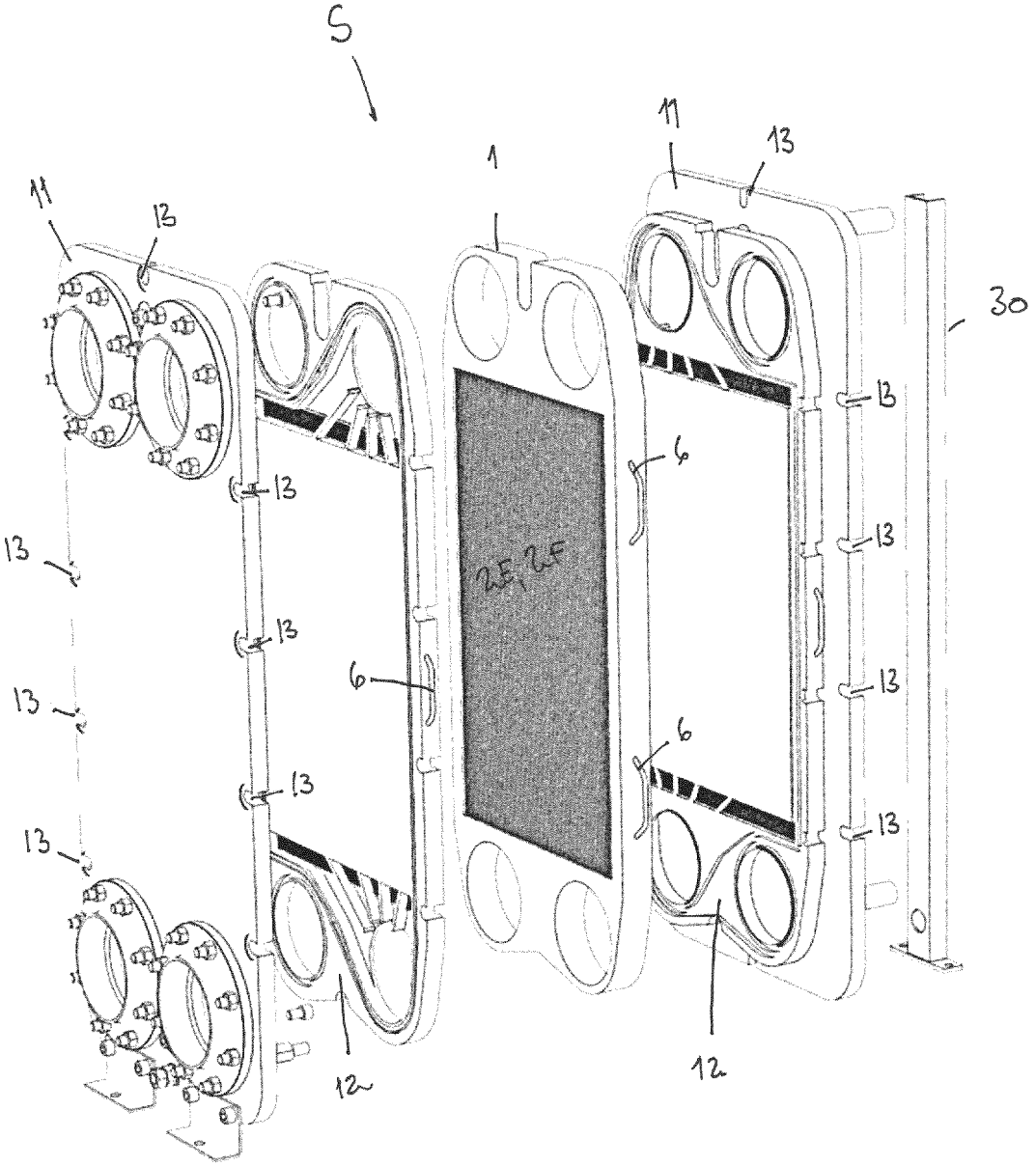
Figure 4A:
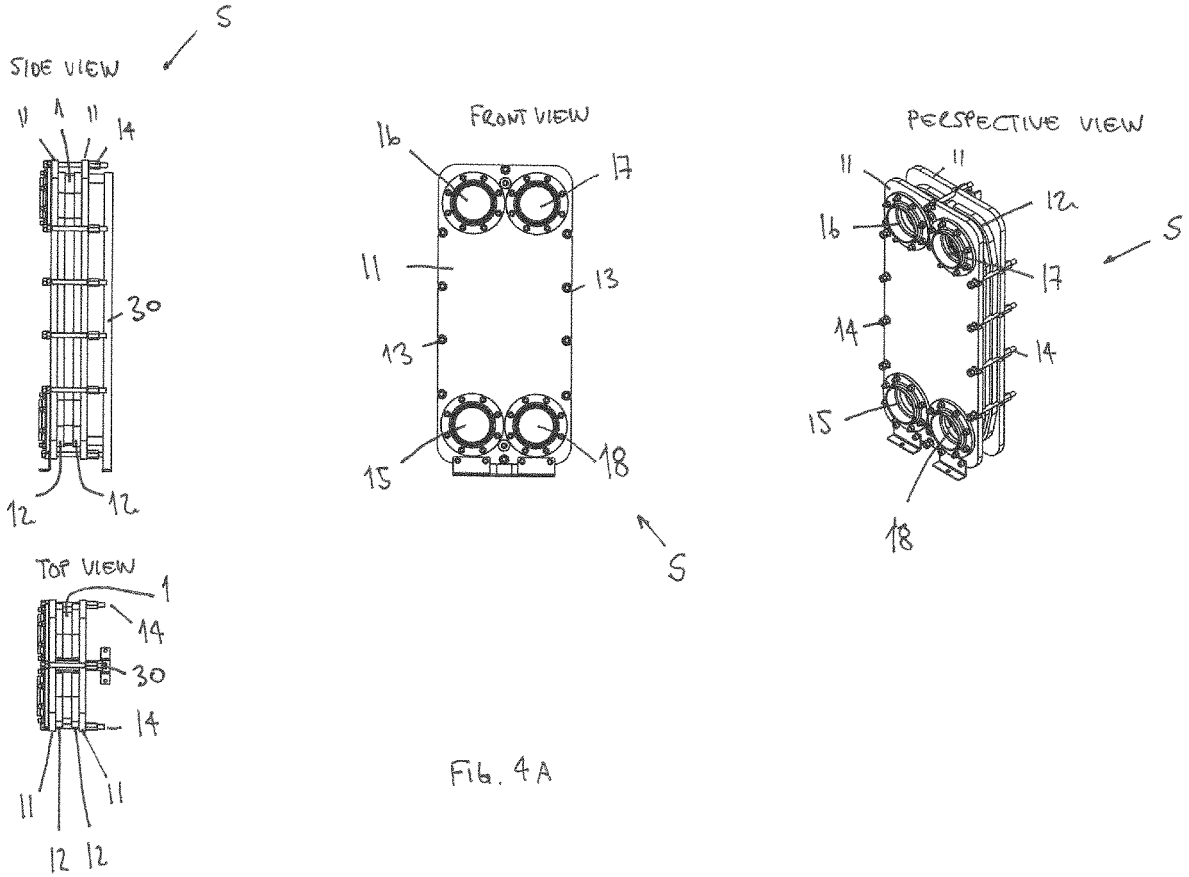
Figure 4B:
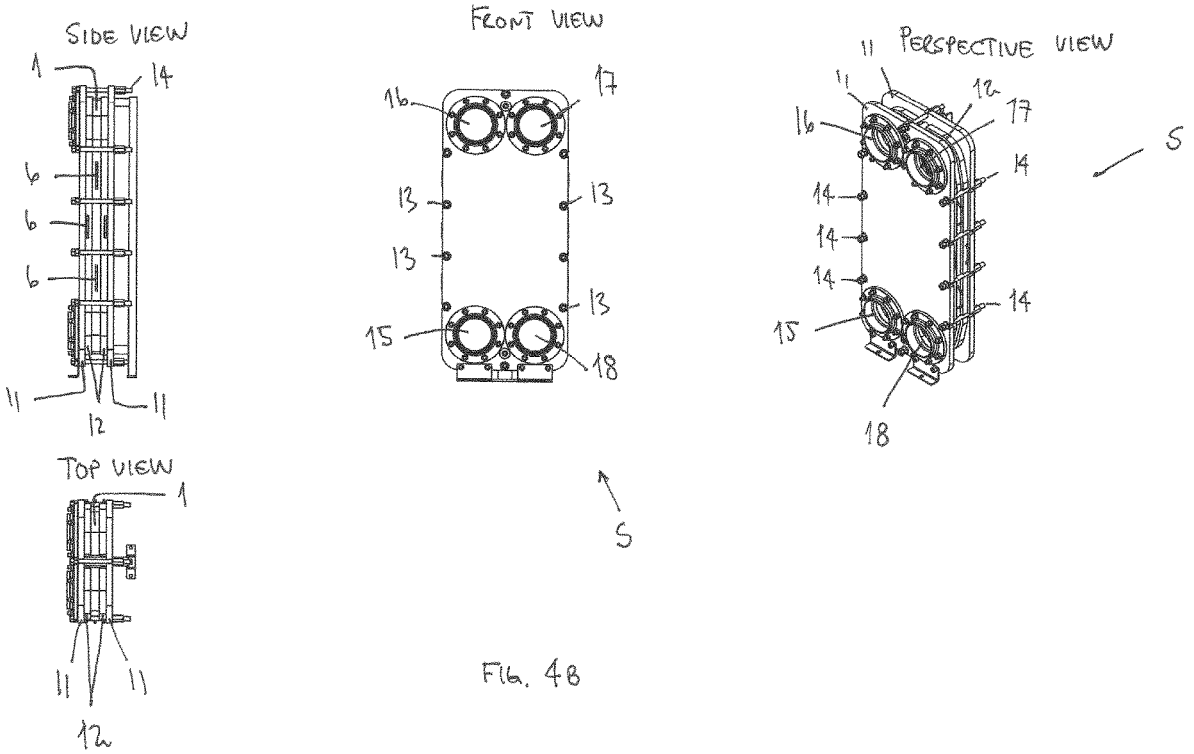
Figure 4C:
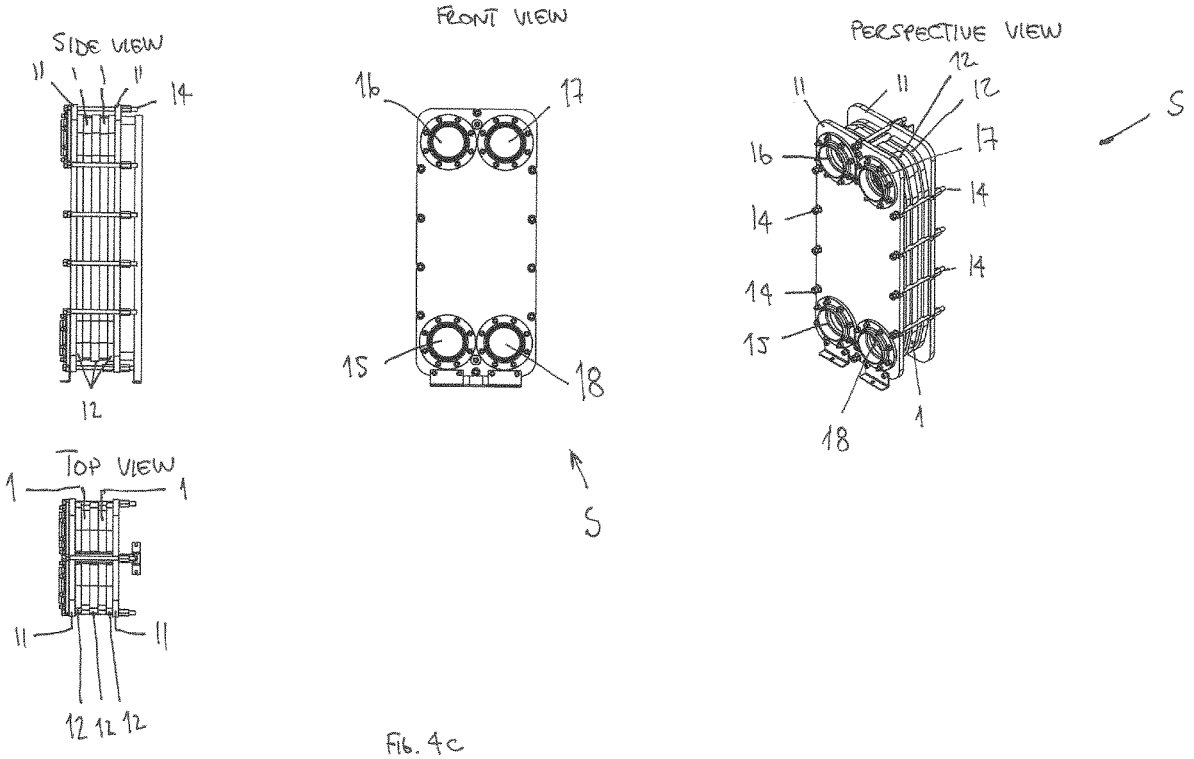
Figure 4D:
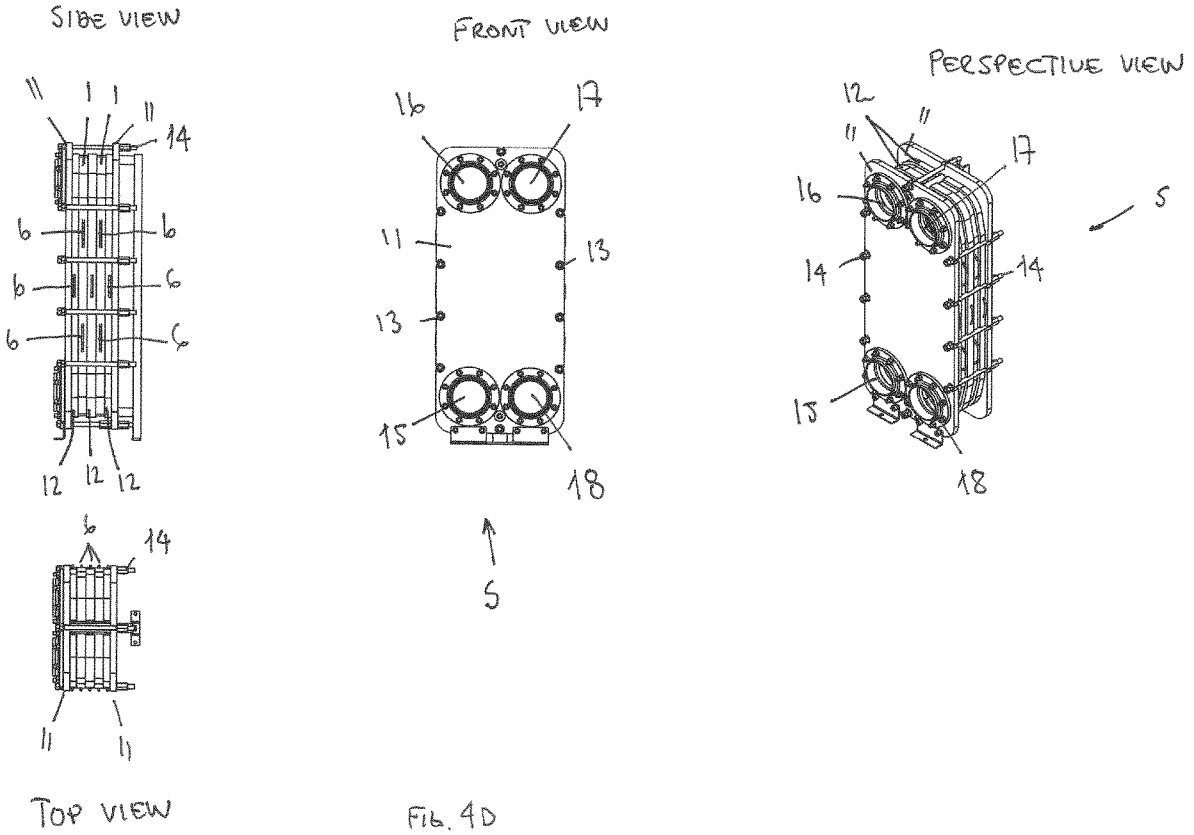
Figure 4E:
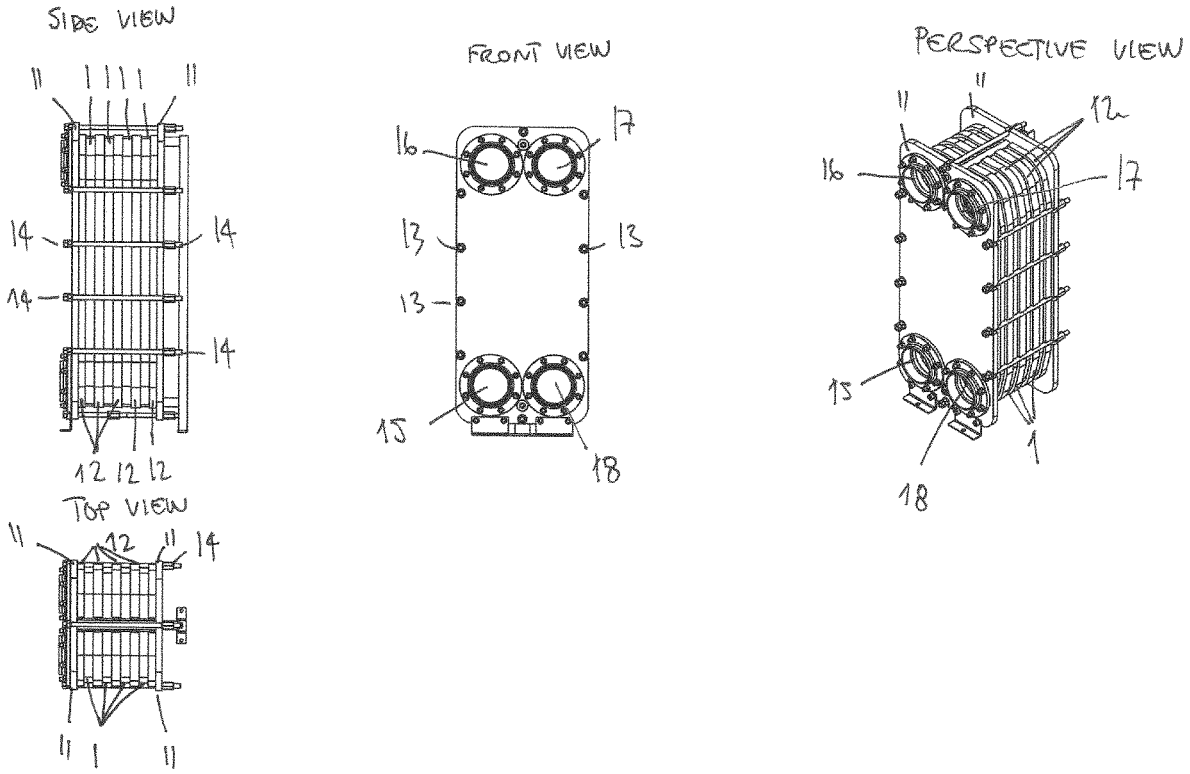
Figure 4F:
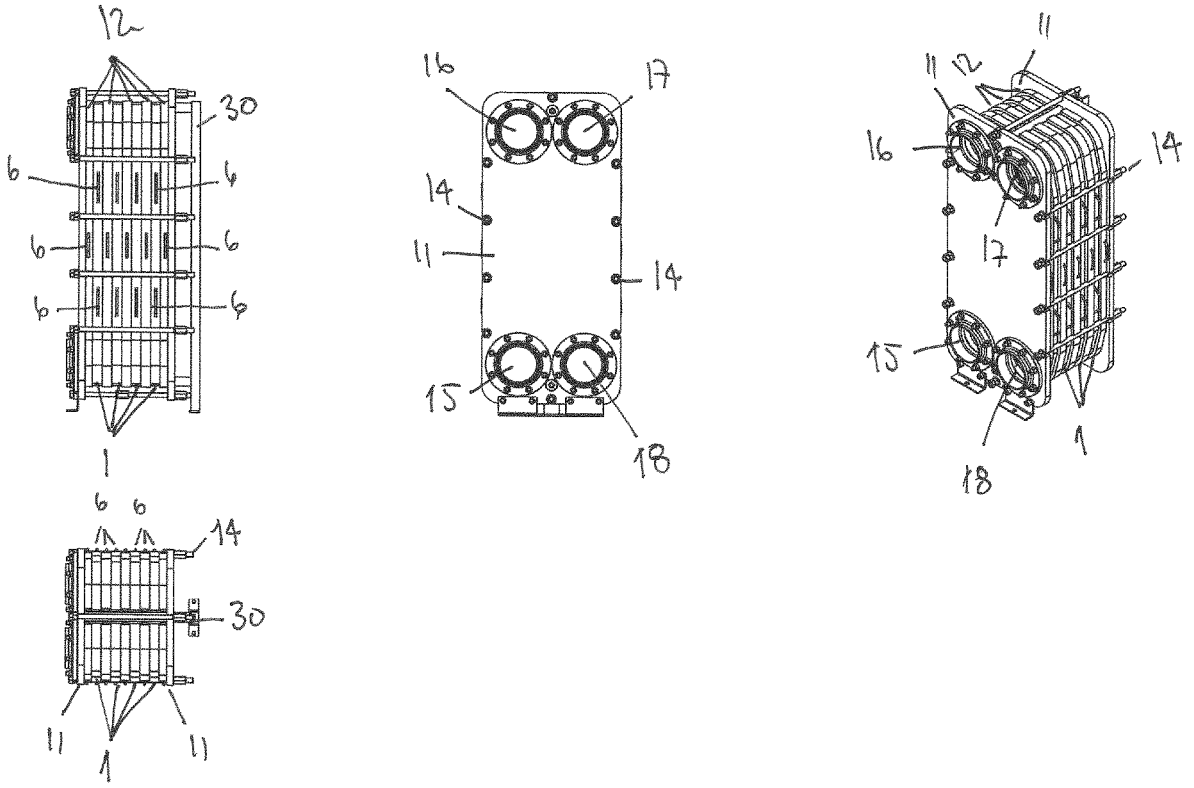
Figure 5A:
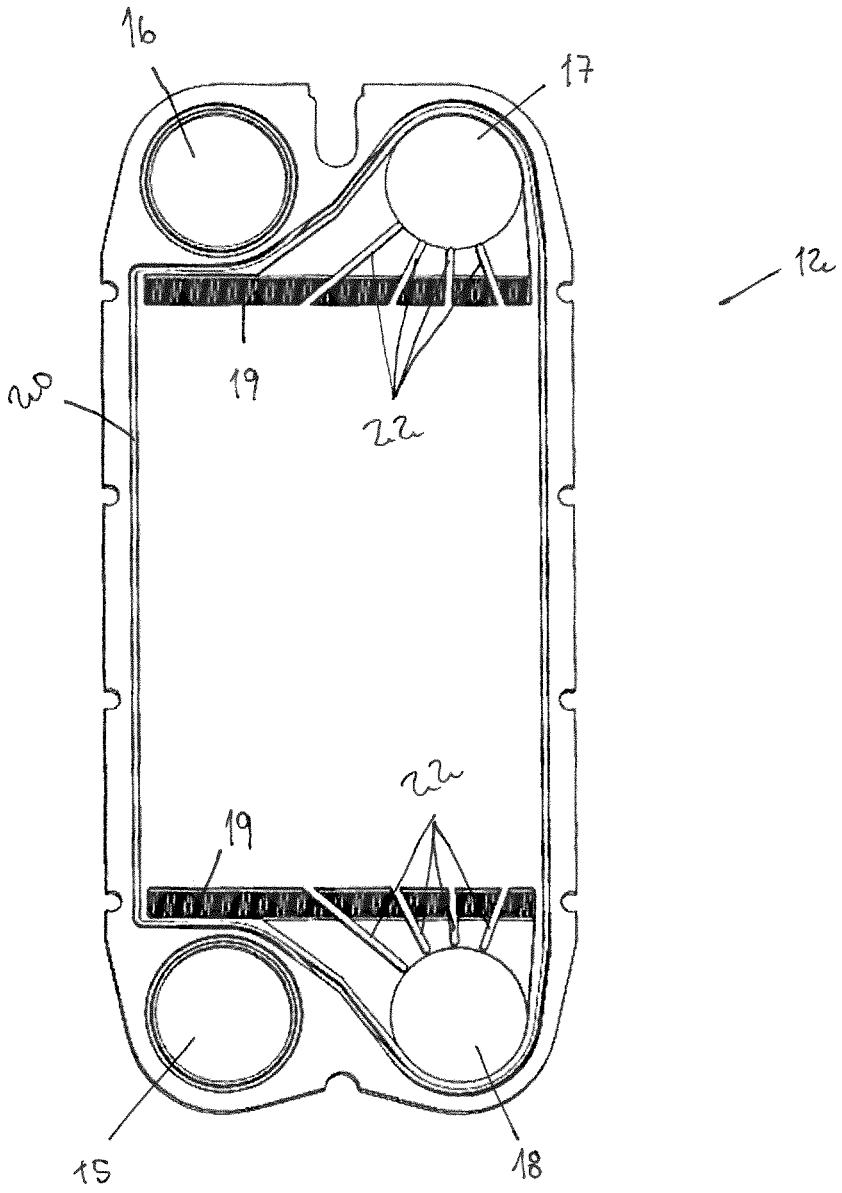
Figure 5B:
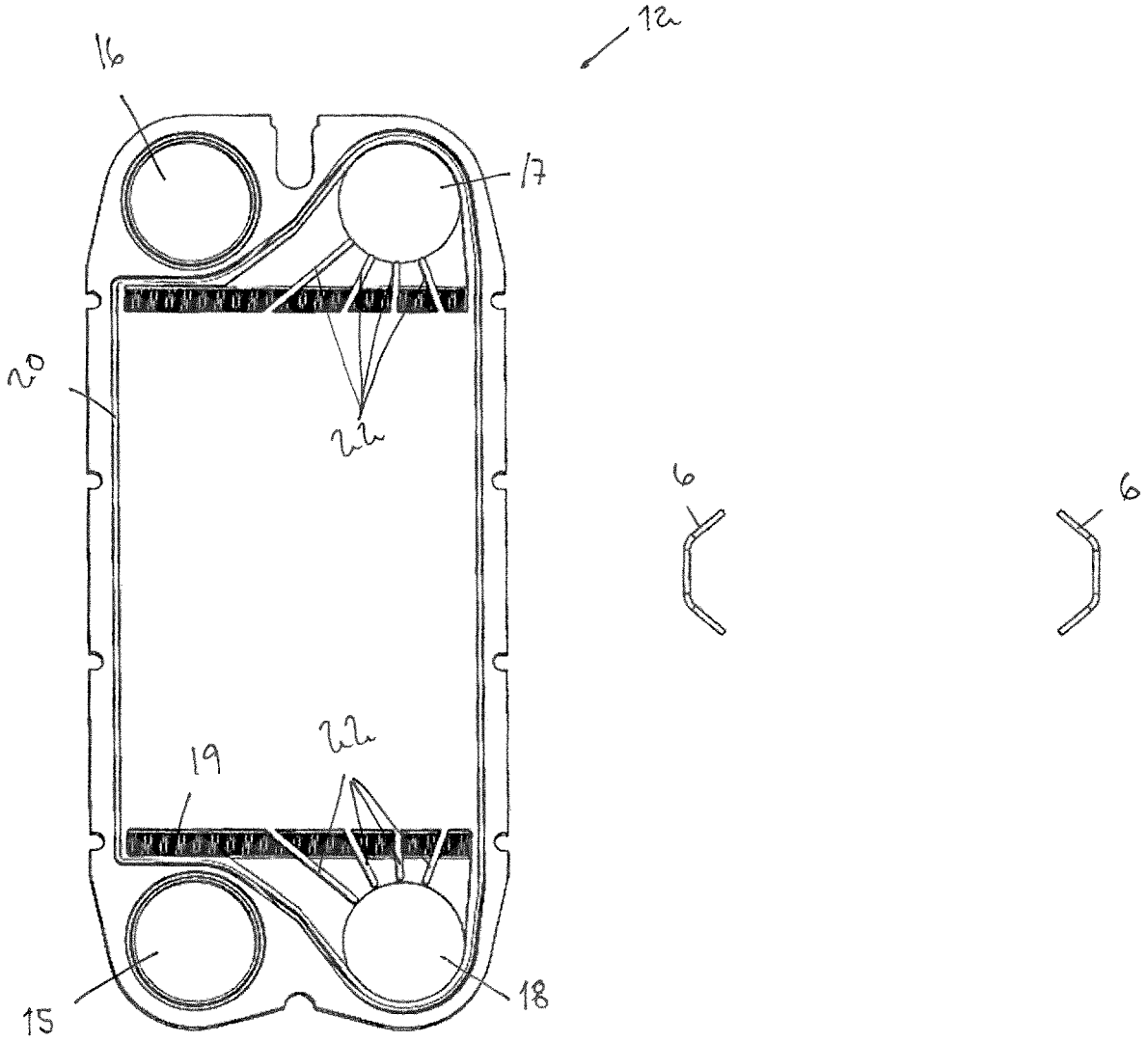
Figure 5C:
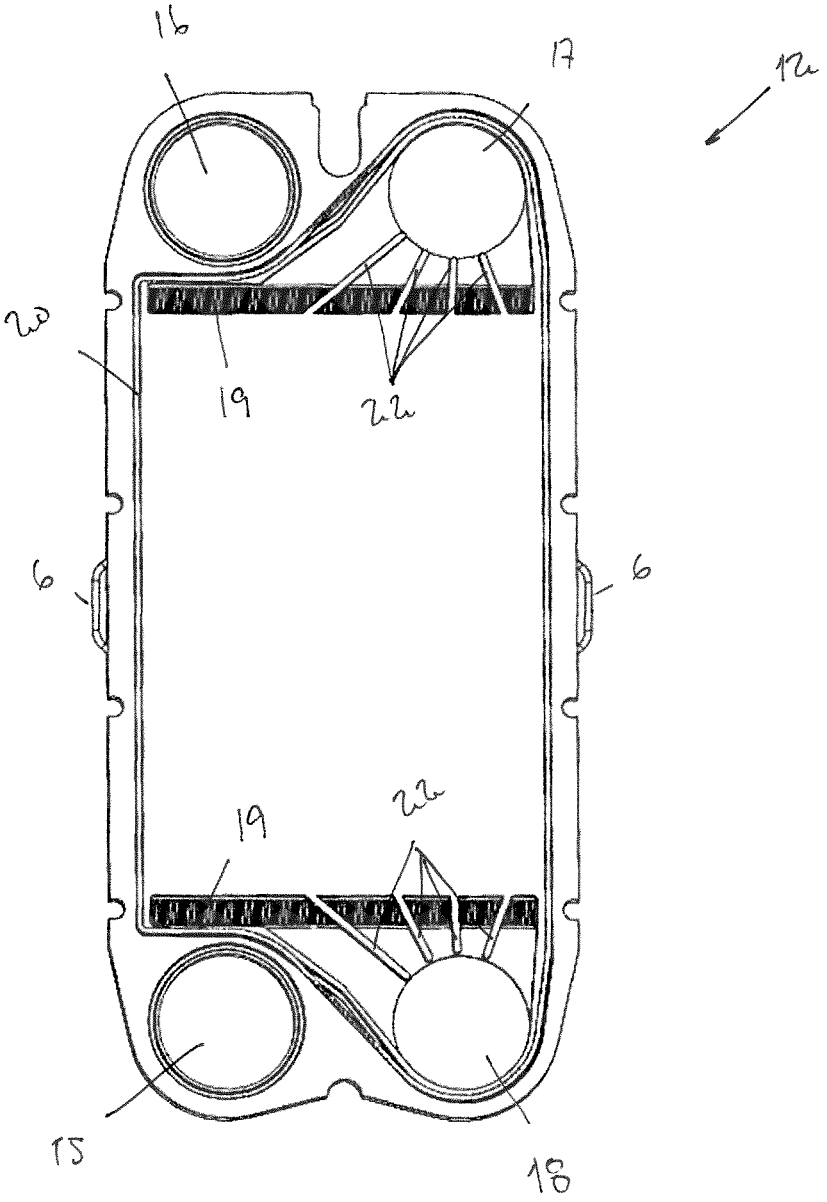
Figure 6A:
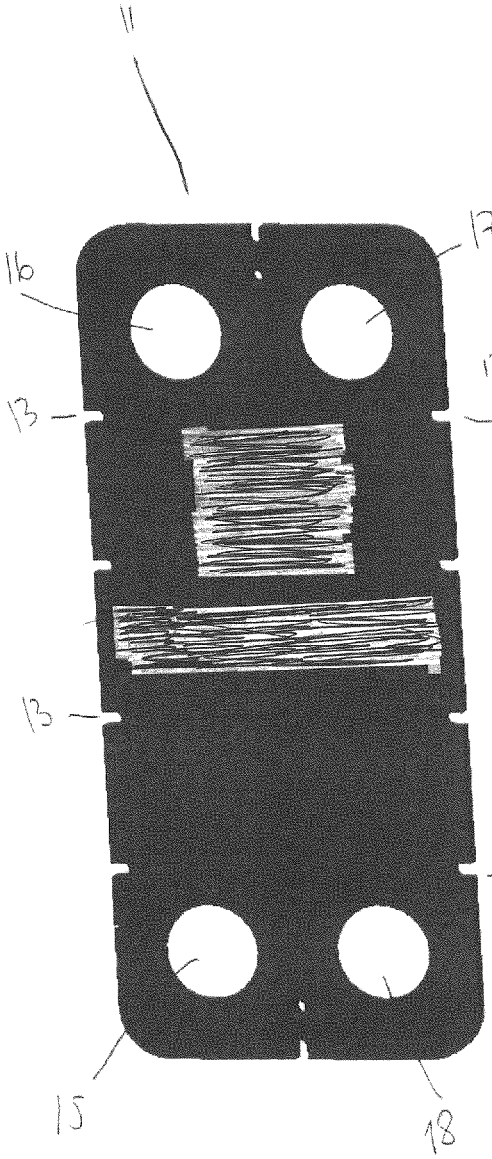
Figure 6B:
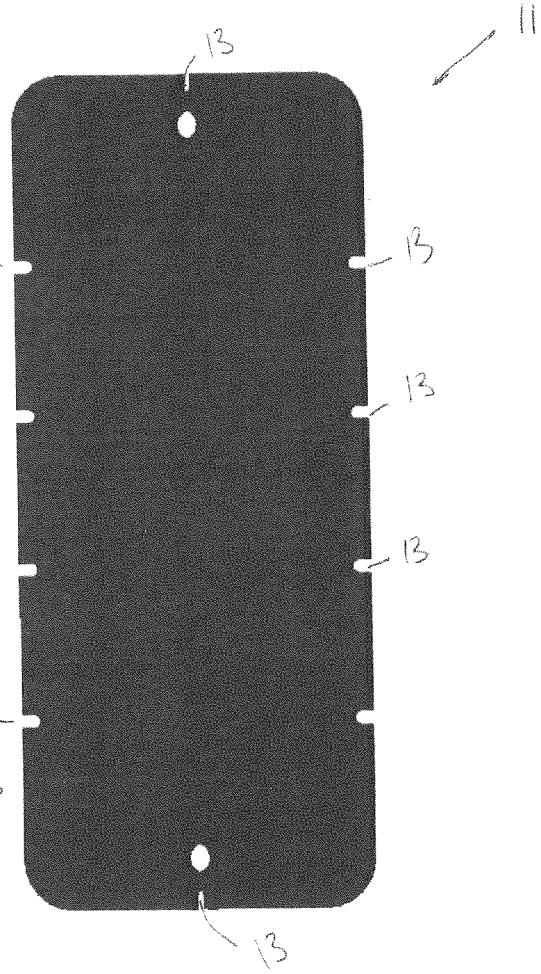

The present invention will now be described in more detail with reference to the following figures, wherein FIGS. 1A-1F show a heat exchanger element for heat exchange between two or more fluids according to the present invention, where FIG. 1A shows the components of the heat exchanger element in an exploded view and from above, FIG. 1B shows the heat exchanger element in an assembled or casted state, in a perspective view, FIG. 1C shows the heat exchanger element from above, from a side and from an underside and upper side, FIGS. 1D-1F show an alternative exemplary embodiment of the heat exchanger element according to FIGS. 1A-1C, where FIG. 1D show the components of the heat exchanger element in an exploded view and from above, FIG. 1E shows the heat exchanger element in an assembled or casted state, in a perspective view and FIG. 1F shows the heat exchanger element from above, from a side and from an underside and upper side, FIGS. 2A-2C show a sheet material of the heat exchanger element according to FIGS. 1A-1F, where FIG. 2A shows the sheet material prior to a folding of the sheet material, FIG. 2B shows an exemplary embodiment of the sheet material when folded, in a perspective view, and FIG. 2C shows an alternative exemplary embodiment of the sheet material according to FIG. 2B, FIGS. 3A-3B show an embodiment of a modular heat exchanger system according to the present invention, where FIG. 3A shows the modular heat exchanger system in an exploded view and FIG. 3B shows an alternative embodiment of the modular heat exchanger system according to FIG. 3A, FIGS. 4A-4F show alternative embodiments of the modular heat exchanger system according to FIG. 3A-3B, seen from above, from a side and from an underside and upper side, where FIGS. 4A-4B comprise one heat exchanger element, FIGS. 4C-4D comprise two heat exchanger elements and FIGS. 4E-4F comprise four heat exchanger elements, FIGS. 5A-5C show a guiding element according to the present invention, where FIG. 5A shows an exemplary embodiment of the guiding element from an underside (or upper side), FIG. 5B shows an alternative embodiment of the guiding element according to FIG. 5A, in an exploded view, and FIG. 5C shows the guiding element in an assembled state, and FIGS. 6A-6B show a front panel and back panel of the modular heat exchanger system according to FIGS. 4A-4F.

FIGS. 1A-1F show alternative embodiments of a heat exchanger element 1 for heat exchange between two or more fluids according to the present invention, where FIGS. 1A-1C show an embodiment of the heat exchanger element 1 comprising a folded sheet material 2 and an outer casing 3.

A first embodiment of a heat exchanger element 1 is shown in FIGS. 1A-1C, where the heat exchanger element 1 is manufactured through a method comprising the following steps: the sheet material 2 is folded to provide a plurality of slits 7 in the sheet material 2, where the sheet material 2, when folded, will have four end surfaces 2A-2D and two opposite heat transfer surfaces 2E, 2F (only one is seen), where the slits 7 will extend in a longitudinal direction L of the folded sheet material 2. Thereafter, the folded sheet material 2 comprising the plurality of slits 7 is placed in a mould (not shown), whereafter a material, for instance polyurethane (PU), is poured into the mould (not shown) to cast the folded sheet material 2 into a frame which will form the outer casing 3 in the heat exchanger element 1, the moulding providing a one-piece heat exchanger element 1 where the outer casing 3 covers only the end surfaces 2A-2D of the folded sheet material 2 and leaving the two opposite heat transfer surfaces 2E-2F exposed through a central opening 4, the moulding further providing two through holes 5 on opposite sides of the central opening 4 of the outer casing 3, the two through holes 5 forming the inlets and outlets for each fluid.

The outer casing 3 will thus cover only an outer circumference of the folded sheet material 2, thereby providing a central opening 4 in the outer casing 3 such that the central opening 4 exposes both sides of the folded sheet material 2, i.e. both an upper side and an underside of the heat exchanger element 1 (or a front side and a backside), each of the two sides forming the heat transfer surface 2E, 2F of the heat exchanger element 1.

The finished heat exchanger element 1 according to the first embodiment and manufactured by the above described method is shown in FIG. 1B.

An alternative embodiment of a heat exchanger element 1 is shown in FIG. 1D, where this heat exchanger element 1 is manufactured in the same way as the heat exchanger element 1 according to FIG. 1A-1C, but where the heat exchanger element 1 in this embodiment in addition comprises a plurality of handles 6 being integrated in the heat exchanger element 1; the folded sheet material 2 provided with a plurality of slits 7 and having four end surfaces 2A-2D and two opposite heat transfer surfaces 2E, 2F is placed, together with four handles 6, in a mould (not shown), whereafter a material, for instance polyurethane (PU), is poured into the mould (not shown) to cast the folded sheet material 2, the plurality of handles 6 and the outer casing 3 in one piece, where the moulding will provide a heat exchanger element 1 where the outer casing 3 covers only the end surfaces 2A-2D of the folded sheet material 2 and leaving the two opposite heat transfer surfaces 2E-2F exposed through a central opening 4, the moulding further providing two through holes 5 on opposite sides of the central opening 4 of the outer casing 3, the two through holes 5 forming the inlets and outlets for each fluid.

FIG. 1E shows the finished heat exchanger element 1 according to the second embodiment and manufactured by the above described method.

However, a person skilled in the art would know that also other materials than polyurethane could be used when manufacturing the heat exchanger element 1, for instance an epoxy or the like.

The outer casing 3 of the heat exchanger element 1 will thus integrate with and cover the folded sheet material 2 around a circumference of the folded sheet material 2 (i.e. the end surfaces 2A-2D), while the two opposite heat transfer surfaces 2E-2F will be open and exposed to the surroundings.

The above method for manufacturing of the heat exchanger element 1 will provide a fluid tight connection between the outer casing 3 and the folded sheet material 2, whereby the heat exchanger element 1 may be manufactured without the use of gaskets, seals or the like.

In one embodiment the heat exchanger element 1 may be manufactured in that one end surface, for instance 2A, of the folded sheet material 2 is placed in the mould (not shown) and a material, for instance polyurethane (PU) is poured into the mould. When this has solidified, the process is repeated for an opposite end surface 2B of the folded sheet material 2. Thereafter the process is repeated for each of the two remaining end surfaces 2C-2D of the folded sheet material 2.

The heat exchanger element 1 may be manufactured with or without the one or more handles 6. When the heat exchanger element 1 is manufactured with the one or more handles 6, the one or more handles will be added in the mould with the folded sheet material 2.

FIGS. 1B-1C show the first embodiment of the heat exchanger element 1 in a perspective view, from a side view, a front view, a top view and a back view, while FIGS. 1D-1F show the second embodiment of the heat exchanger element 1 in a perspective view, from a side view, a front view, a top view and a back view.

FIGS. 2A-2C show the sheet material 2 of the heat exchanger element 1, where it can be seen that the sheet material 2 is configured with a number of subsequent stamped portions 8 and non-stamped portions 9, where the non-stamped portions 9 are arranged between two adjacent stamped portions 8. The stamped portions 8 will, when the sheet material 2 is folded, constitute the slits 7 in the heat exchange element 1, through which slits 7 a fluid is to flow. The non-stamped portions 9 will then form the "folding areas" for the sheet material 2, i.e. the sheet material 2 is folded at the non-stamped portions 9.

The stamping of the stamped portions 8 will provide necessary strength in the heat exchanger element 1 to prevent the heat exchanger element 1 from collapsing if the differential pressure across the heat exchanger element 1 becomes too large and will provide a turbulent flow in the fluids that are run through the heat exchanger element 1.

Although the stamping of the stamped portions 8 in this embodiment is shown to have a "V-form", a person skilled in the art would know that the stamping may also have other "patterns" or forms.

The stamping may, for example, be done in a press (not shown) or the like, where the sheet material 2 is fed through the press, a portion 8 of the sheet material 2 is stamped, then the press (not shown) is lifted and a new length of the sheet material 2 is advanced into the press, whereafter the press stamps a new portion 8 of the sheet material 2. This process is repeated until the desired number of stamped portions 8 has been obtained.

The sheet material 2 will then through a "folding process" be folded about the non-stamped portions 9, such that the sheet material 2 will have a form as shown in FIGS. 2B-2C. This will provide a folded sheet material 2, where two stamped portions 8 will form a slit 7 in the heat exchanger element 1, where the first fluid that flows through a slit 7 on one side of the folded sheet material 2 will be "surrounded" by two slits 7 on the other side of the folded sheet material 2, through which two slits 7 the second fluid flows.

Although the slits 7 in FIGS. 2A-2C are shown as planar faces, it should be understood that they may be configured as part circles, arcs or the like.

Furthermore, the non-stamped portions 9 may have a width, as an example, of 2.5 mm-3.5 mm, but this width may also be more or less, depending on the specific application of the heat exchanger element 1.

The first and the last portion of the sheet material 2 will be configured with an extra "folding point". The fold 10 is made so that a part of this first and last portion of the sheet material 2 will be arranged perpendicular to the subsequent stamped portion 8; see also FIGS. 2B-2C. This folded portion 10, i.e., the portion that projects perpendicularly out from the folded sheet material 2, will then constitute attachment points to the outer casing 3.

FIG. 2B shows an embodiment where the fold 10 is made to be half a width or height of the stamped portion 8, while FIG. 2C shows an embodiment where the fold 10 is made to be at a "bottom" of the folded sheet material 2.

FIGS. 3A-3B show embodiments of a modular system S for heat exchange between fluids according to the present invention, where FIG. 3A shows a first embodiment of the modular system S in an exploded view, and FIG. 3B shows a second embodiment of the modular system S in an exploded view.

The modular system S for heat exchange between fluids in this exemplary embodiment comprises two end plates 11 (or a front plate and a back plate), where two guiding elements 12 and one heat exchanger element 1 are arranged between the two end plates 11, one guiding element 12 being arranged on each side of the heat exchanger element 1.

The heat exchanger element 1 is arranged between the two guiding elements 12, such that the modular system S for heat exchange between fluids will be assembled in the following way: a front plate 11, a first guiding element 12, a heat exchanger element 1, a second guiding element 12 and a back plate 11.

Each end plate 11 is provided with a plurality of recesses 13 or notches around a circumference of the end plate 11, such that a corresponding number of locking elements 14 may be used to assemble and fasten the end plates 11, guiding elements 12 and heat exchanger element 1.

The locking elements 14 may be rods, bars or the like, where the locking elements 14 are provided with threads so as to be connected with a nut.

An inlet filter (not shown) is in a suitable way, for example, with the aid of bolts or the like, connected to one of the end plates 11, which inlet filter will reduce the danger of physical blockages in the modular system S for heat exchange between fluids, as a result of contaminants in one or both of the fluids to be heat exchanged.

One of the end plates 11 is further configured with an inlet and outlet 15, 16; 17, 18 (see also FIG. 6A) for each of the fluids to be heat exchanged, where the inlet and outlet 15, 16 for a first fluid and the inlet and outlet 17, 18 for a second fluid are arranged on opposite edges of the end plate 11.

The inlet 15 for the first fluid will then be arranged diagonally opposite to the inlet 17 for the second fluid, and similarly the outlet 16 for the first fluid will be arranged diagonally opposite the outlet 18 for the second fluid. Thus, the fluids that are to be heat exchanged will flow in the opposite direction to each other when the system S for heat exchange between fluids is used, so as to achieve optimal heat transfer between the fluids.

How the pipes (not shown) for supply of the fluids to be heat exchanged are to be connected to the modular system S for heat exchange between fluids is not described in any detail here, as a person of skill in the art will know how this is to be done.

The heat exchanger elements 1, when the modular system S for heat exchange between fluids comprises more than one heat exchanger element 1, are so arranged between the end plates 11 that two sides facing each other in two adjacent heat exchanger elements 1 will carry the same fluid, which mean, that a first and a second heat exchanger element 1 on the sides facing each other will carry the first fluid, whilst sides in the second and a third heat exchanger element 1 will then carry the second fluid.

In the embodiment shown in FIG. 3A the modular system S for heat exchange between fluids comprises two guiding elements 12 and one heat exchanger element 2 that are not manufactured with handles 6, while the modular system S for heat exchange between fluids shown in FIG. 3B comprises two guiding elements 12 and one heat exchanger element 2 that are manufactured with handles 6.

However, a person skilled in the art would understand that a greater or smaller number of heat exchanger elements 1 and guiding elements 12 may be arranged between the two end plates 11, where the number of heat exchanger elements 1 and guiding elements 12 depends on space available, desired capacity, back-up capacity and development potential. The guiding elements 12 and the heat exchangers elements 1 are then arranged successively following one another. Furthermore, the heat exchanger elements 2 are arranged such that two adjacent or consecutive heat exchanger elements 2 (with a guiding element 12 arranged between them) carry the same fluid between the sides that faces each other.

When the modular system S for heat exchange between fluids is assembled, the system S may, in appropriate ways, be connected to a stand 30 or rack in order to hold the modular system S in a fixed position.

The above is shown in FIGS. 4A-4F, where FIGS. 4A-4B show a modular system S for heat exchange between fluids in an assembled state and comprising one heat exchange element 1 and two guiding elements 12, where the heat exchange element 1 and the two guiding elements 12 are shown without handles in FIG. 4A and provided with handles 6 in FIG. 4B; FIGS. 4C-4D show a modular system S for heat exchange between fluids in an assembled state and comprising two heat exchange elements 1 and three guiding elements 12, where the two heat exchange elements 1 and the three guiding elements 12 are shown without handles in FIG. 4C and provided with handles 6 in FIG. 4D; and FIGS. 4E-4F show a modular system S for heat exchange between fluids in an assembled state and comprising four heat exchange elements 1 and five guiding elements 12, where the four heat exchange elements 1 and the five guiding elements 12 are shown without handles in FIG. 4E and provided with handles 6 in FIG. 4F.

FIGS. 5A-5C show a guiding element 12 according to the present invention, where the guiding element 12 is arranged adjacent to the heat exchanger element 1 in order to direct and force the fluid to flow through the slits 7 in the heat exchanger element 1.

Furthermore, each guiding element 12 is configured with inlet and outlet 15, 16; 17, 18 for each of the fluids to be heat exchanged, where the inlet and outlet 15, 16 for a first fluid and the inlet and outlet 17, 18 for a second fluid are arranged on opposite edges of the guiding element 12.

As explained for the end plate 11, the inlet 15 for the first fluid will then be arranged diagonally opposite to the inlet 17 for the second fluid, and similarly the outlet 16 for the first fluid will be arranged diagonally opposite the outlet 18 for the second fluid. Thus, the fluids that are to be heat exchanged will flow in the opposite direction to each other when the system S for heat exchange between fluids is used, so as to achieve optimal heat transfer between the fluids.

Each guiding element 12 is also provided with a filter 19 arranged on one side of the guiding element 12, and where the guiding element 12 is provided with a bead or edge 20 arranged to form an enclosure around the inlet 15 and outlet 16 for the first fluid.

Similarly, an opposite side of the guiding element 12 may also be provided with a bead or edge 21 arranged to form an enclosure around the inlet 17 and outlet 18 for the second fluid.

Guiding elements 12 will help leading or forcing the fluid through the inlets and outlets of the heat exchanger elements 1 and also through the heat exchanger elements 1.

Each guiding element 12 will also contribute with a strength to withstand a fluid pressure inside the modular system S for heat exchange between fluids (both the actual fluid pressure and the differential pressure, i.e. the pressure difference between the fluids.

A height and/or width of a guiding element 12 may therefore be larger than a height and/or width of a heat exchanger element 1.

FIGS. 5B-5C show an alternative embodiment of the guiding element 12 according to FIG. 5A, where handles 6 are integrated in the guiding element 12 in this embodiment; FIG. 5B showing the guiding element 12 in an exploded view and FIG. 5C showing the assembled guiding element 12.

FIGS. 6A-6B show a front plate and a back plate 11 of the modular system S for heat exchange between fluids, where each end plate 11 is provided with a plurality of recesses 13 or notches around a circumference of the end plate 11, such that a corresponding number of locking elements 14 may be used to assemble and fasten the end plates 11, guiding elements 12 and heat exchanger element 1.

The locking elements 14 may be rods or the like, where the locking elements 14 are provided with threads so as to be connected with a nut.

The front plate 11 is further configured with an inlet and outlet 15, 16; 17, 18 for each of the fluids to be heat exchanged, where the inlet and outlet 15, 16 for a first fluid and the inlet and outlet 17, 18 for a second fluid are arranged on opposite edges of the end plate 11.

The inlet 15 for the first fluid will then be arranged diagonally opposite to the inlet 17 for the second fluid, and similarly the outlet 16 for the first fluid will be arranged diagonally opposite the outlet 18 for the second fluid. Thus, the fluids that are to be heat exchanged will flow in the opposite direction to each other when the system S for heat exchange between fluids is used, so as to achieve optimal heat transfer between the fluids.

Furthermore, the inlets and outlets 15, 16, 17, 18 for fluids provided in the end plate(s) 11, the guiding elements 12 and the heat exchanger elements 1 are provided such that, when the modular system S for heat exchange between fluids is assembled, the inlets and outlets 15, 16, 17, 18 for fluids in each element 1, 11, 12 will align with corresponding inlets and outlets 15, 16, 17, 18 in remaining elements, so that there is no need to seal against fluid in different planes or heights.

The invention has now been explained with reference to a non-limiting exemplary embodiment. A person of skill in the art will understand however that a number of variations and modifications can be made to the system for heat exchange between fluids and the open element as described within the scope of the invention, as defined in the appended claims.

The invention claimed is:

1. A modular system for heat exchange between fluids, comprising two end plates, wherein at least one end plate is configured with inlets and outlets for fluids, the modular system comprising:

a number of heat exchanger elements and a number of guiding elements, wherein each heat exchanger element comprises a folded sheet material comprising a plurality of slits extending in a longitudinal direction of the folded sheet material, which longitudinal extending slits form the fluids flow paths, an outer casing being cast onto the folded sheet material forming one piece, wherein a central opening of the outer casing covers an outer circumference of the folded sheet material, exposing a front side and a back side of the folded sheet material where two through holes, forming the inlets and outlets for each fluid, are provided on each side opposite of the central opening of the outer casing, wherein each guiding element comprises two inlets and two outlets for fluids, and a bead or edge, provided on one side, forming an enclosure around the inlet and outlet for a first fluid, and a bead or edge on an opposite side, forming an enclosure around the inlet and outlet for a second fluid, wherein heat exchanger elements and guiding elements are arranged successively following each other, the heat exchanger elements being arranged such that two adjacent heat exchanger elements on sides facing each other carry the same fluid.

2. The modular system according to claim 1, wherein the sheet material is made of titanium.

3. The modular system according to claim 1, wherein a ratio between a slit width and slit depth of a slit is less than 0.15.

4. The modular system according to claim 1, wherein walls of the slits in the folded sheet material are configured as planar faces, part circles or arcs.

5. The modular system according to claim 1, wherein the guiding element further comprises at least a filter provided on either end of the guiding element.

6. The modular system according to claim 1, wherein at least one end plate comprises an inlet and outlet for each of the fluids to be heat exchanged.

7. The modular system according to claim 1, wherein the end plates are provided with a plurality of recesses around a circumference of the end plate, wherein a corresponding number of locking elements cooperate with the plurality of recesses to assemble and fasten the end plates, guiding elements and heat exchanger elements.

8. The modular system according to claim 2, wherein walls of the slits in the folded sheet material are configured as planar faces, part circles or arcs.

9. The modular system according to claim 3, wherein walls of the slits in the folded sheet material are configured as planar faces, part circles or arcs.

10. The modular system according to claim 6, wherein the end plates are provided with a plurality of recesses around a circumference of the end plate, wherein a corresponding number of locking elements cooperate with the plurality of recesses to assemble and fasten the end plates, guiding elements and heat exchanger elements.

11. A method for manufacturing a modular system for heat exchange between fluids, the heat exchanger element comprising two end plates, wherein at least one end plate is configured with inlets and outlets for fluids, the modular system comprising:

a number of heat exchanger elements and a number of guiding elements, wherein each heat exchanger element comprises a folded sheet material comprising a plurality of slits extending in a longitudinal direction of the folded sheet material, which longitudinal extending slits form the fluids flow paths, an outer casing being cast onto the folded sheet material forming one piece, wherein a central opening of the outer casing covers an outer circumference of the folded sheet material, exposing a front side and a back side of the folded sheet material where two through holes, forming the inlets and outlets for each fluid, are provided on each side opposite of the central opening of the outer casing, wherein each guiding element comprises two inlets and two outlets for fluids, and a bead or edge, provided on one side, forming an enclosure around the inlet and outlet for a first fluid, and a bead or edge on an opposite side, forming an enclosure around the inlet and outlet for a second fluid, wherein heat exchanger elements and guiding elements are arranged successively following each other, the heat exchanger elements being arranged such that two adjacent heat exchanger elements on sides facing each other carry the same fluid, wherein the method comprises:

folding a sheet material into the folded sheet material with the plurality of slits extending parallel to the longitudinal direction of the folded sheet material, forming the fluids flow paths via the longitudinal extending slits, wherein a ratio between a slit width and a slit depth of each slit is less than 0.15;

placing the folded sheet material into a mould, and adding a material into the mould to cast the folded sheet material and the outer casing in one piece, wherein the central opening of the outer casing covers an outer circumference of the folded sheet material, thereby exposing opposite sides of the folded sheet material.

12. The method according to claim 11, the method further comprising:

adding a plurality of handles into the mould.

* * * * *